US009010897B2

(12) United States Patent
Tanase et al.

(10) Patent No.: US 9,010,897 B2
(45) Date of Patent: Apr. 21, 2015

(54) FLUID-EJECTING DEVICE AND FLUID-EJECTING METHOD FOR EJECTING A FLUID BY A FIRST NOZZLE COLUMN AND A SECOND NOZZLE COLUMN THAT FORM AN OVERLAPPING REGION

(75) Inventors: Kazuyoshi Tanase, Nagano (JP); Toru Miyamoto, Nagano (JP); Toru Takahashi, Nagano (JP); Takamitsu Kondo, Nagano (JP); Hiroshi Wada, Nagano (JP); Naoki Maruyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 27 days.

(21) Appl. No.: 13/396,826

(22) Filed: Feb. 15, 2012

(65) Prior Publication Data

US 2012/0206525 A1 Aug. 16, 2012

(30) Foreign Application Priority Data

Feb. 15, 2011 (JP) ..... 2011-030073

(51) Int. Cl.

| | |
|---|---|
| ***B41J 29/38*** | (2006.01) |
| ***B41J 2/155*** | (2006.01) |
| ***B41J 2/21*** | (2006.01) |

(52) U.S. Cl.

CPC ..... *B41J 2/155* (2013.01); *B41J 2/2132* (2013.01)

(58) Field of Classification Search

CPC ..... B41J 2/2132; B41J 2/155
USPC ..... 347/5, 41, 40, 14, 9, 42
See application file for complete search history.

(56) References Cited

U.S. PATENT DOCUMENTS

| | | | | |
|---|---|---|---|---|
| 2002/0024557 | A1 * | 2/2002 | Matsumoto et al. | 347/42 |
| 2004/0095420 | A1 * | 5/2004 | Ikemoto et al. | 347/40 |
| 2006/0214957 | A1 * | 9/2006 | Wada | 347/5 |
| 2007/0165068 | A1 * | 7/2007 | Tsuboi | 347/41 |
| 2007/0242098 | A1 * | 10/2007 | Sudo et al. | 347/40 |
| 2008/0123148 | A1 | 5/2008 | Takahashi et al. | |
| 2009/0268240 | A1 | 10/2009 | Watanabe et al. | |
| 2010/0118318 | A1 | 5/2010 | Fuse et al. | |
| 2011/0063354 | A1 * | 3/2011 | Enge | 347/14 |
| 2011/0273729 | A1 | 11/2011 | Tanase et al. | |
| 2011/0316911 | A1 * | 12/2011 | Ishikawa et al. | 347/9 |

FOREIGN PATENT DOCUMENTS

| | | | |
|---|---|---|---|
| CN | 102241195 A | | 11/2011 |
| EP | 0914950 | * | 5/1999 |
| JP | 06-255175 A | | 9/1994 |
| JP | 2004-122546 A | | 4/2004 |
| JP | 2008-093965 A | | 4/2008 |

(Continued)

*Primary Examiner* — Laura Martin
*Assistant Examiner* — Carlos A Martinez
(74) *Attorney, Agent, or Firm* — Global IP Counselors, LLP

(57) ABSTRACT

To minimize any decrease in image quality, even in an instance in which there is a displacement in a landing position of a fluid in a region in which nozzle rows overlap, (A) a fluid-ejecting device including: a first nozzle column; (B) a second nozzle column, the second nozzle column being arranged so as to form an overlapping region; and (C) a control part for causing the fluid to be ejected so that in each of a plurality of raster lines arranged in a row in the predetermined direction in the overlapping region, dots to be formed are apportioned between the first nozzles and the second nozzles; the control part causing the fluid to be ejected so that there are produced.

8 Claims, 23 Drawing Sheets

(56) References Cited

FOREIGN PATENT DOCUMENTS

| | | | |
|---|---|---|---|
| JP | 2009-262455 | A | 11/2009 |
| JP | 2010-137553 | A | 6/2010 |
| JP | 2010-155374 | A | 7/2010 |
| JP | 2010-274485 | A | 12/2010 |

* cited by examiner

Fig. 11A
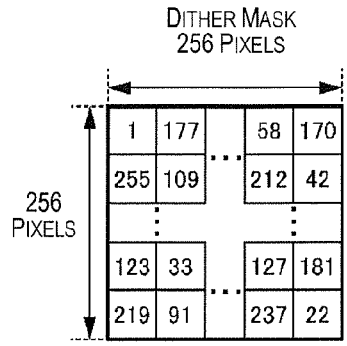
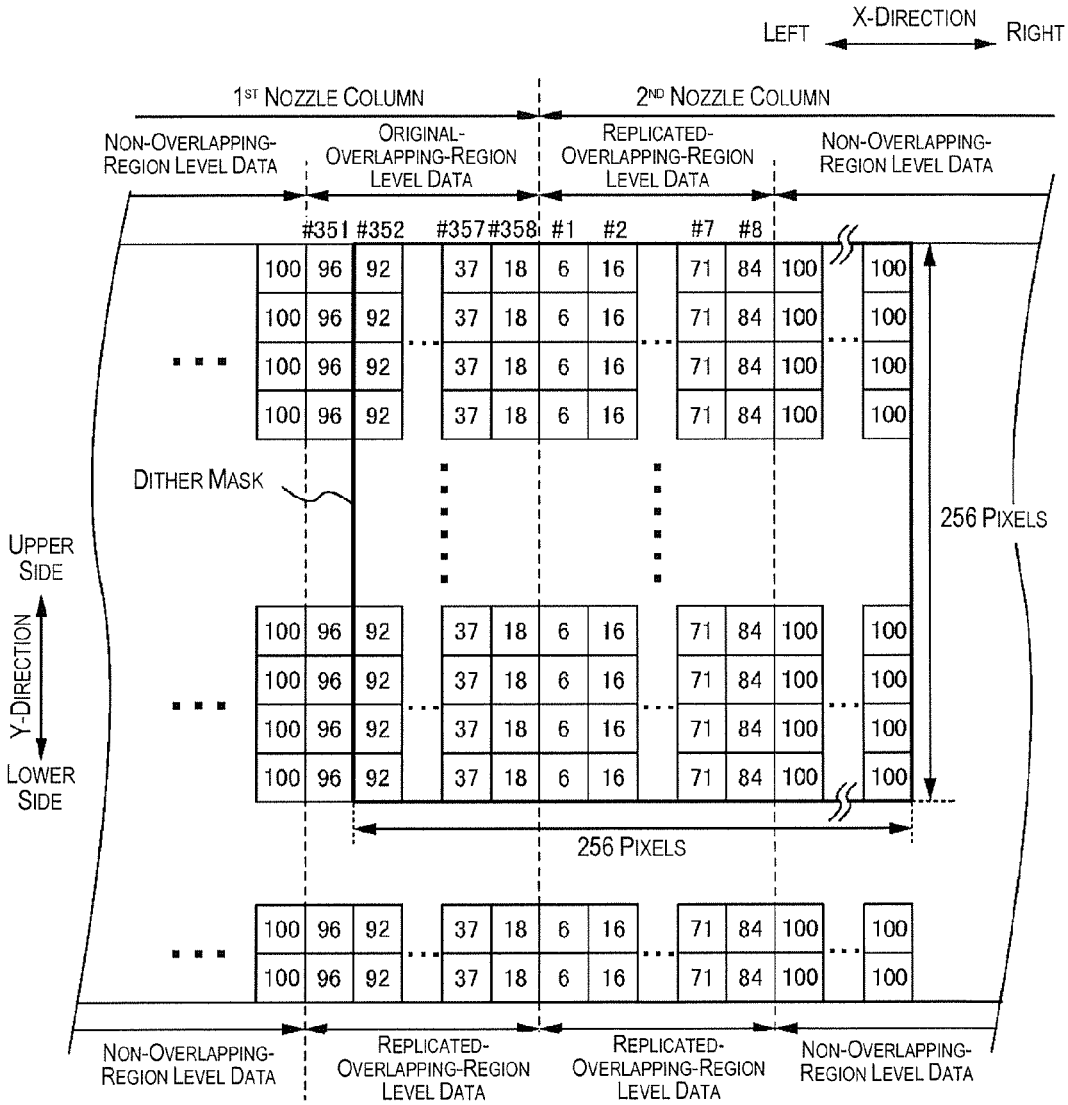
Fig. 11B

DITHER MATRIX IN WHICH ELEMENTS STORING THRESHOLDS 0 THROUGH 24 HAVE BEEN ESTABLISHED

COLUMN NUMBER

| ROW NUMBER | 1 | 2 | 3 | 4 | 5 | 6 | 7 | 8 | 9 | 10 |
|---|---|---|---|---|---|---|---|---|---|---|
| 1 | 17 | | | | 7 | | | | | 14 |
| 2 | | | 1 | | | | | | 24 | |
| 3 | | | | | | 20 | | 5 | | |
| 4 | | 13 | | | 10 | | | | | |
| 5 | | | 6 | | | | | | | 11 |
| 6 | | 23 | | | | 2 | | 15 | | |
| 7 | 19 | | 9 | | | | 0 | | | |
| 8 | | | | | 22 | | | 4 | | |
| 9 | | 3 | | 16 | | | 21 | | | |
| 10 | 12 | | | | | 8 | | | 18 | |

MG24

STATE OF FORMATION OF DOTS CORRESPONDING TO ELEMENTS STORING ESTABLISHED THRESHOLDS

COLUMN NUMBER

| ROW NUMBER | 1 | 2 | 3 | 4 | 5 | 6 | 7 | 8 | 9 | 10 |
|---|---|---|---|---|---|---|---|---|---|---|
| 1 | ● | | | | ● | | | | | ● |
| 2 | | | ● | | | | | | ● | |
| 3 | | | | | | ● | | ● | | |
| 4 | | ● | | | ● | | | | | |
| 5 | | | ● | | | | | | | ● |
| 6 | | ● | | | | ● | | ● | | |
| 7 | ● | | ● | | | | ● | | | |
| 8 | | | | | ● | | | ● | | |
| 9 | | ● | | ● | | | ● | | | |
| 10 | ● | | | | | ● | | | ● | |

Dda

● CORRESPONDS TO ELEMENT STORING ESTABLISHED THRESHOLD

Fig. 14

COLUMN NUMBER

| ROW NUMBER | 1 | 2 | 3 | 4 | 5 | 6 | 7 | 8 | 9 | 10 | NUMBER OF ESTABLISHED THRESHOLDS IN ROW DIRECTION |
|---|---|---|---|---|---|---|---|---|---|---|---|
| 1 | 17 | *1 | *2 | *3 | 7 | | | | | 14 | 3 |
| 2 | | | 1 | | | | | | 24 | | 2 |
| 3 | | | | | | 20 | | 5 | | | 2 |
| 4 | | 13 | | | 10 | | | | | | 2 |
| 5 | | | 6 | | | | | | | 11 | 2 |
| 6 | | 23 | | | | 2 | | 15 | | | 3 |
| 7 | 19 | | 9 | | | | 0 | | | | 3 |
| 8 | | | | | 22 | | | 4 | | | 2 |
| 9 | | 3 | | 16 | | | 21 | | | | 3 |
| 10 | 12 | | | | | 8 | | | 18 | | 3 |
| NUMBER OF ESTABLISHED THRESHOLDS IN COLUMN DIRECTION | 3 | 3 | 3 | 1 | 3 | 3 | 2 | 3 | 2 | 2 | |

COLUMN NUMBER

| ROW NUMBER | 1 | 2 | 3 | 4 | 5 | 6 | 7 | 8 | 9 | 10 |
|---|---|---|---|---|---|---|---|---|---|---|
| 1 | 1 | 0 | 0 | 0 | 0 | 0 | 1 | 0 | 0 | 1 |
| 2 | 0 | 0 | 1 | 0 | 0 | 0 | 0 | 0 | 1 | 0 |
| 3 | 0 | 0 | 0 | 0 | 0 | 1 | 0 | 1 | 0 | 0 |
| 4 | 0 | 1 | 0 | 0 | 1 | 0 | 0 | 0 | 0 | 0 |
| 5 | 0 | 0 | 1 | 0 | 0 | 0 | 0 | 0 | 0 | 1 |
| 6 | 0 | 1 | 0 | 0 | 0 | 1 | 0 | 1 | 0 | 0 |
| 7 | 1 | 0 | 1 | 0 | 0 | 0 | 1 | 0 | 0 | 0 |
| 8 | 0 | 0 | 0 | 0 | 1 | 0 | 0 | 1 | 0 | 0 |
| 9 | 0 | 1 | 0 | 1 | 0 | 0 | 1 | 0 | 0 | 0 |
| 10 | 1 | 0 | 0 | 0 | 0 | 1 | 0 | 0 | 1 | 0 |

Dda1

FLUID-EJECTING DEVICE AND FLUID-EJECTING METHOD FOR EJECTING A FLUID BY A FIRST NOZZLE COLUMN AND A SECOND NOZZLE COLUMN THAT FORM AN OVERLAPPING REGION

CROSS-REFERENCE TO RELATED APPLICATIONS

This application claims priority to Japanese Patent Application No. 2011-030073 filed on Feb. 15, 2011. The entire disclosure of Japanese Patent Application No. 2011-030073 is hereby incorporated herein by reference.

BACKGROUND

1. Technical Field

The present invention relates to a fluid-ejecting device and a fluid-ejecting method.

2. Background Technology

Inkjet printers ("printers" hereafter) for ejecting ink (fluid) from nozzles provided to a head and forming an image are an example of a fluid-ejecting device. An example of a printer of such description is a printer in which a plurality of short heads are arranged in a direction of paper width; and ink is ejected from the heads, and an image is formed, onto a medium conveyed under the heads.

In Patent Citation 1, there is disclosed a printer in which a plurality of heads are arranged so that end parts (a part of a nozzle column) of each of the heads overlap.

Japanese Patent Application Publication No. 6-255175 (Patent Citation 1) is an example of the related art.

SUMMARY

Problems to be Solved by the Invention

Printers in which end parts of heads overlap include those in which a dot intended to be formed (dot data after halftone processing) at a position where the heads come together (referred to as "overlapping region" hereafter) is allocated, for printing, to one of the heads arranged in the direction of paper width. In the overlapping region, a dot is formed by a head on an upstream side; then, the medium is conveyed, and a dot is formed by a head on a downstream side.

However, in an instance in which the medium is not conveyed in proper alignment, a dot can be formed at a position that is different from a position at which the dot was originally intended to be formed. In such an instance, the head on the downstream side can form a dot on top of the dot formed by the head on the upstream side, while some pixels can not have a dot formed by either of the heads. Such a displacement in the ink landing position in the overlapping region in which the heads (nozzle columns) overlap causes unevenness in color and reduces image quality. Therefore, the image quality is preferably not reduced, even in an instance in which a displacement occurs in the landing position of a fluid body such as an ink.

With the foregoing circumstances in view, an advantage of the invention is to minimize any decrease in image quality, even in an instance in which a displacement occurs in the landing position of a fluid body in a region in which nozzle columns overlap.

Means Used to Solve the Above-Mentioned Problems

A principal aspect of the invention for attaining the above-mentioned advantage is a fluid-ejecting device including:

(A) a first nozzle column, in which first nozzles for ejecting a fluid are arranged in a predetermined direction;

(B) a second nozzle column, in which second nozzles for ejecting a fluid are arranged in the predetermined direction, the second nozzle column being arranged so as to form an overlapping region in which an end part on one side in the predetermined direction is superimposed over an end part of the first nozzle column on another side in the predetermined direction; and (C) a control part for causing the fluid to be ejected so that in each of a plurality of raster lines arranged in a row in the predetermined direction in the overlapping region, dots to be formed are apportioned between the first nozzles and the second nozzles;

the control part causing the fluid to be ejected so that there are produced, in a raster line in the overlapping region, a pixel in which a dot formed by a first nozzle and a dot formed by a second nozzle are overlappingly formed, and a pixel in which only one of a dot formed by the first nozzle and a dot formed by the second nozzle are formed.

Other characteristics of the invention will be described in the present specifications and the accompanying drawings.

BRIEF DESCRIPTION OF THE DRAWINGS

Referring now to the attached drawings which form a part of this original disclosure:

FIG. 11A shows a dithering mask;

FIG. 11B shows a scheme of the halftone process performed by dithering;

FIG. 14 is a drawing used to illustrate a matrix MG24 showing a scheme in which the first 25 thresholds (0 through 24) for which a dot is most readily formed are stored in a matrix, and to illustrate a scheme in which a dot is formed on each of 25 pixels corresponding to those elements.

DETAILED DESCRIPTION OF EXEMPLARY EMBODIMENTS

Figure 1A:
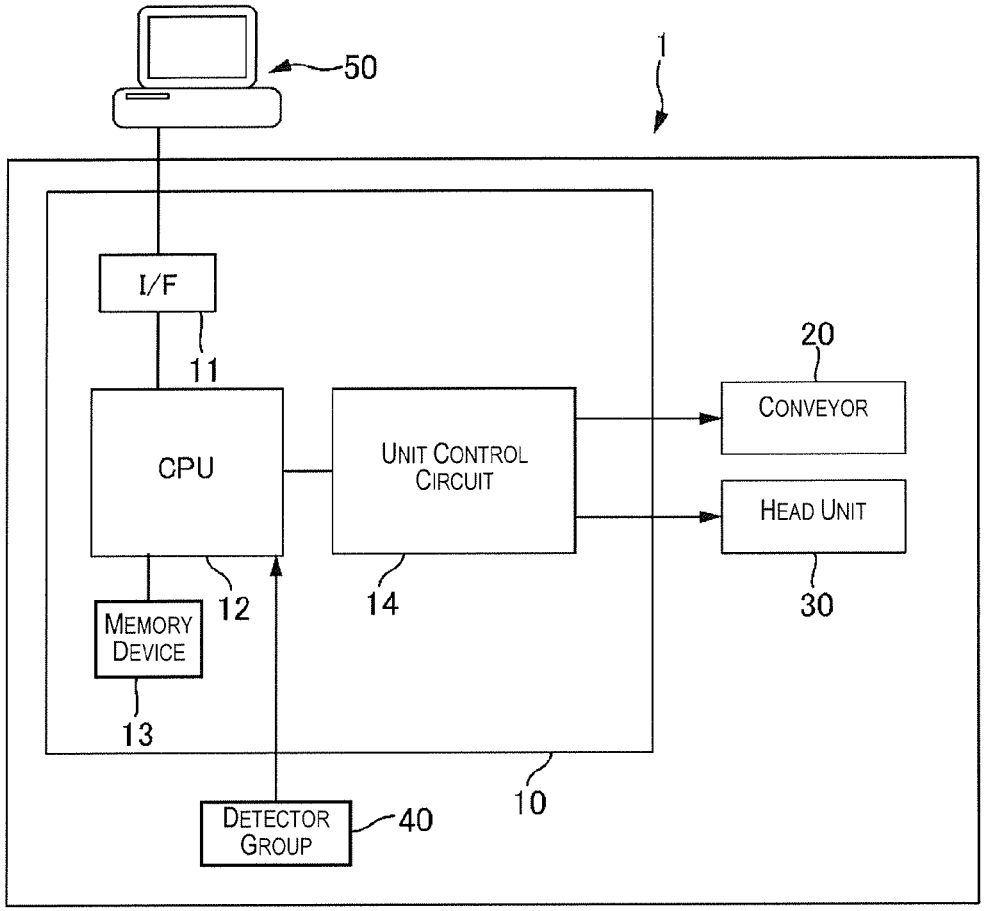
FIG. 1A is a block diagram showing an overall configuration of a printer 1.

At least the following matter is made apparent by the present specifications and the accompanying drawings.

A fluid-ejecting device including:

(A) a first nozzle column, in which first nozzles for ejecting a fluid are arranged in a predetermined direction;

(B) a second nozzle column, in which second nozzles for ejecting a fluid are arranged in the predetermined direction, the second nozzle column being arranged so as to form an overlapping region in which an end part on one side in the predetermined direction is superimposed over an end part of the first nozzle column on another side in the predetermined direction; and (C) a control part for causing the fluid to be ejected so that in each of a plurality of raster lines arranged in a row in the predetermined direction in the overlapping region, dots to be formed are apportioned between the first nozzles and the second nozzles;

the control part causing the fluid to be ejected so that there are produced, in a raster line in the overlapping region, a pixel in which a dot formed by a first nozzle and a dot formed by a second nozzle are formed in a superimposed manner, and a pixel in which only one of a dot formed by the first nozzle and a dot formed by the second nozzle are formed.

Thus, the fluid is ejected so that there are produced, in the overlapping region, a pixel in which a dot from a first nozzle and a dot from a second nozzle are formed. Therefore, even if the medium is not conveyed in proper alignment and there is a displacement in the position at which a dot is formed, it is possible to reduce the possibility of there being generated a pixel in which no dot is formed at all. Specifically, even in an instance in which there is a displacement in a landing position of a fluid in a region in which nozzle columns overlap, it is possible to reduce the likelihood of a white spot being produced and to minimize any decrease in image quality.

Preferably, in the fluid-ejecting device, the control part causes the fluid to be ejected so that the number of dots generated in the overlapping region is larger than the number of dots generated in a non-overlapping region, which is not the overlapping region.

Thus, in the overlapping region, the number of dots generated is larger than that in the non-overlapping region, and it is possible to reduce the number of pixels in which a dot is prevented from forming due to the medium not being conveyed in proper alignment or another cause. It is then possible to reduce the likelihood of a white spot being generated, and minimize any decrease in image quality.

Preferably, an average amount of the fluid ejected in the overlapping region is equal to an average amount of the fluid ejected in the non-overlapping region.

Thus, even though the number of dots generated in the overlapping region is larger, the amount of fluid ejected is equal to that in the non-overlapping region, whereby it is possible to prevent the density from increasing solely in the overlapping region.

Preferably, the control part is a control part for ejecting the fluid from the first nozzle column and the second nozzle column according to dot data indicating a dot size converted from an input image data; wherein the control part causes, in the overlapping region, the fluid to be ejected from the first nozzles according to dot data obtained by multiplying incidence rate data for each of the dot sizes by a usage rate of the first nozzle column, and then performing a halftone process; and causes, in the overlapping region, the fluid to be ejected from the second nozzles according to dot data obtained by multiplying incidence rate data for each of the dot sizes by a usage rate of the second nozzle column, and then performing a halftone process.

Thus, it is possible to perform a halftone process on data that corresponds to the nozzle usage rate, and to form dots according to the corresponding results. Therefore, the graininess of the dots in the overlapping region can be mitigated.

Preferably, the usage rate of the first nozzles and the usage rate of the second nozzles differ in accordance with the input image data.

Thus, while the probability of dots overlapping each other varies according to the gradation in the input image data, the configuration described above makes it possible to use a dot usage rate corresponding to the gradation in the input image data to adjust the number of dots generated.

Preferably, the incidence rate data for each of the dot sizes is determined in accordance with a table showing dot size, formed in accordance with a gradation value of the input image data, and the incidence rate at the corresponding dot size; and with regards to the table, a different table is used between the overlapping region and the non-overlapping region, which is not the overlapping region.

Thus, for an overlapping region, it is possible to use a table that causes smaller dots to be generated at a high probability compared to that used for the non-overlapping region.

The following matter is also made apparent by the present specifications and the accompanying drawings. Specifically, the following matter is also made apparent by the present specifications and the accompanying drawings. Specifically, a fluid-ejecting device including:

(A) a head including nozzle columns in which nozzles for ejecting a fluid are arranged in a row in a predetermined direction;

(B) a movement part for moving the head along an intersecting direction that intersects with the predetermined direction;

(C) a conveyor for conveying a medium, onto which the fluid is ejected, along the predetermined direction; and (D) a control part for causing the head to perform a first dot-forming operation for causing the head to move along the intersecting direction and eject the fluid;

subsequently conveying the medium;

causing the head to perform a second dot-forming operation for causing the head to move along the intersecting direction and eject the fluid;

causing one end of the nozzle column used during the first dot-forming operation and another end of the nozzle column used during the second dot-forming operation to form an overlapping region on the medium; and causing the fluid to be ejected so that there are produced, on a raster line in the overlapping region, a pixel in which a dot formed by the first dot-forming operation and a dot formed by the second dot-forming operation are formed in a superimposed manner, and a pixel in which only one of either a dot formed by the first dot-forming operation or a dot formed by the second dot-forming operation is formed.

Thus, the fluid is ejected so that there is produced a pixel, in the overlapping region, in which there are formed a dot formed by the first dot-forming operation and a dot formed by the second dot-forming operation; therefore, even if the head is not conveyed in proper alignment when moved, and there is a displacement in the position at which a dot is to be formed, it is possible to reduce the possibility of there being any pixels in which no dot is formed at all. Specifically, even in an instance in which there is a displacement in a landing position of a fluid in the overlapping region, it is possible to reduce the likelihood of a white spot being generated, and to minimize any decrease in image quality.

The following matter is also made apparent by the present specifications and the accompanying drawings. Specifically, a fluid-ejecting method for ejecting a fluid from a fluid-ejecting device including: a first nozzle column, in which first nozzles for ejecting a fluid are arranged in a predetermined direction; and a second nozzle column, in which second nozzles for ejecting a fluid are arranged in the predetermined direction, the second nozzle column being arranged so as to form an overlapping region in which an end part on one side in the predetermined direction is superimposed over an end part of the first nozzle column on another side in the predetermined direction; the fluid-ejecting method including:

(A) a step for producing print data so that there are produced, on a raster line in the overlapping region, a pixel in which a dot formed by a first nozzle and a dot formed by a second nozzle are formed in a superimposed manner, and a pixel in which only one of either a dot formed by the first nozzles or a dot formed by the second nozzles is formed; and (B) a step for ejecting the fluid from the first nozzle column and the second nozzle column according to the print data.

Thus, the fluid is ejected so that there is generated a pixel in which there are formed a dot formed by a first nozzle and a dot formed by a second nozzle; therefore, even if the head is not conveyed in proper alignment, and there is a displacement in the position at which a dot is to be formed, it is possible to reduce the possibility of there being produced a pixel in which no dot is formed at all. Specifically, even in an instance in which there is a displacement in a landing position of a fluid in the region in which nozzle columns overlap, it is possible to reduce the likelihood of a white spot being produced, and to minimize any decrease in image quality.

===System Configuration===

Embodiments will be described in regards to a fluid-ejecting device that is a printing system in which a line head printer ("printer 1" hereafter) in an ink-jet printer and a computer 50 are connected.

Figure 1B:
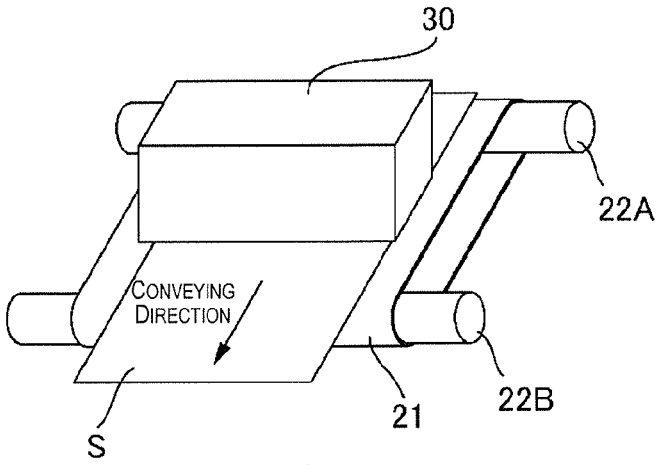
FIG. 1B is a schematic diagram of the printer 1, showing the printer 1 conveying a paper sheet S (medium)

FIG. 1A is a block diagram showing an overall configuration of the printer 1. FIG. 1B is a schematic diagram of the printer 1 showing the printer 1 conveying a paper sheet S (medium). The printer 1, which has received print data from a computer 50, an external device, controls units (a conveyor 20 and a head unit 30) using a controller 10, and prints an image on the paper sheet S. The status in the printer 1 is monitored by a detector group 40, and the controller 10 controls each of the units on the basis of corresponding detection results.

The controller 10 is a control unit for controlling the printer 1. An interface part 11 is used for transmitting/receiving data between the computer 50, which is an external device, and the printer 1. A CPU 12 is an arithmetic processor for controlling the printer 1 overall. A memory device 13 is used for securing a region for storing a program, a task region, or a similar region for the CPU 12. The CPU 12 controls each of the units using a unit control circuit 14 that follows the program stored in the memory device 13.

The conveyor 20 has a conveyor belt 21 and conveying rollers 22A, 22B. The conveyor 20 sends the paper sheet S to a position at which printing is possible, and conveys the paper sheet S in a conveying direction at a predetermined conveying speed. With regards to the paper sheet S fed onto the conveyor belt 21, the conveying rollers 22A, 22B cause the conveyor belt 21 to rotate, whereby the paper sheet S on the conveyor belt 21 is conveyed. The paper sheet S on the conveyor belt 21 can be electrostatically chucked, vacuum-chucked, or otherwise held in place from below.

The head unit 30 is used for ejecting ink droplets onto the paper sheet S, and has a plurality of heads 31. A plurality of nozzles, which are ink-ejecting parts, are provided on a lower surface of each of the heads 31. A pressure chamber containing ink (not shown) and a driving element (piezo element) for changing the volume of the pressure chamber and causing ink to eject are provided to each of the nozzles. In the printer 1 of such description, when the controller 10 receives the print data, the controller 10 first sends the paper sheet S onto the conveyor belt 21. Then, the paper sheet S is conveyed on the conveyor belt 21 at a uniform speed without stopping, and comes to face a nozzle surface of the heads 31. While the paper sheet S is conveyed below the head unit 30, ink droplets are intermittently ejected from each of the nozzles on the basis of image data. As a result, a column of dots (hereafter also referred to as a "raster line") oriented along the conveying direction is formed on the paper sheet S, and an image is printed. The image data is configured from a plurality of pixels arranged two-dimensionally. Each of the pixels (data) shows whether or not a dot is to be formed on a region on the medium corresponding to the respective pixel (pixel region).

<Nozzle Arrangement>

Figure 2A:
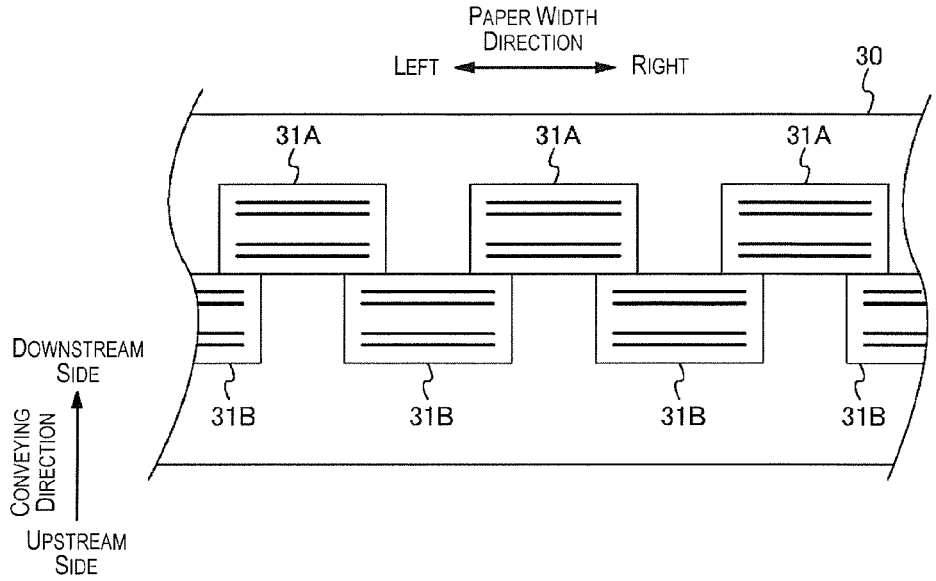
FIG. 2A shows a layout of the heads 31 provided to the head unit 30.
Figure 2B:
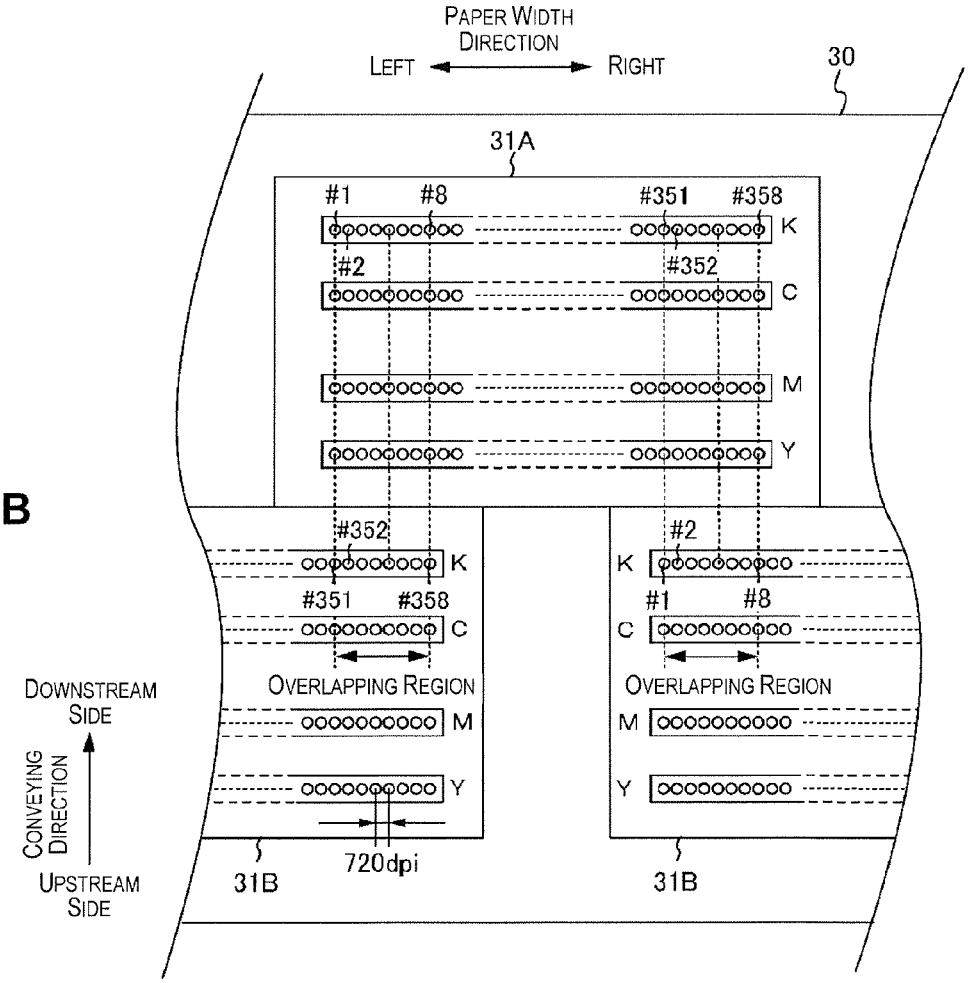
FIG. 2B shows a layout of nozzles on the lower surfaces of the heads 31.

FIG. 2A shows a layout of the heads 31 provided to the head unit 30. FIG. 2B shows a layout of nozzles on the lower surfaces of the heads 31. In the printer 1 of the present embodiment, as shown in FIG. 2A, a plurality of heads 31 are arranged in a row along the paper width direction, which intersects with the conveying direction, and end parts of each of the heads 31 are arranged so as to overlap. Heads 31A, 31B that are adjacent to each other in the paper width direction are arranged so as to be displaced with respect to each other in the conveying direction (i.e., arranged in a staggered manner). Of the heads 31A, 31B that are adjacent to each other in the paper width direction, the head 31A on a downstream side in the conveying direction is referred to as a downstream-side head 31A, and the head 31B on an upstream side in the conveying direction is referred to as an upstream-side head 31B. The heads 31A, 31B that are adjacent to each other in the paper width direction are collectively referred to as "adjacent heads".

FIG. 2B shows the nozzles as viewed in a transparent manner from an upper part of the head. As shown in FIG. 2B, the lower surfaces of each of the heads have formed thereon a black nozzle column K for ejecting black ink, a cyan nozzle column C for ejecting cyan ink, a magenta nozzle column M for ejecting magenta ink, and a yellow nozzle column Y for ejecting yellow ink. Each of the nozzle columns is configured from 358 nozzles (Nos. 1 through 358). Also, the nozzles in each of the nozzle columns are arranged at a uniform interval (e.g., 720 dpi) in the paper width direction. The nozzles belonging to each of the nozzle columns are numbered in ascending order from the left side in the paper width direction (Nos. 1 through 358).

The heads 31A, 31B arranged in a row in the paper width direction are arranged so that eight nozzles at an end part of each of the nozzle columns of each of the heads 31 overlap. Specifically, eight nozzles (Nos. 1 through 8) at a left-side end part of each of the nozzle columns of the downstream-side head 31A are overlapped with eight nozzles (Nos. 351 through 358) at a right-side end part of each of the nozzle columns of the upstream-side head 31B; and eight nozzles (Nos. 351 through 358) at a right-side end part of each of the nozzle columns of the downstream-side head 31A are overlapped with eight nozzles (Nos. 1 through 8) at a left-side end part of each of the nozzle columns of the upstream-side head 31B. As shown in the drawing, a portion of the adjacent heads 31A, 31B at which the nozzles overlap is referred to as the overlapping region. Nozzles belonging to the overlapping region (Nos. 1 through 8 and Nos. 351 through 358) are referred to as overlapping nozzles The positions in the paper width direction of nozzles overlapping at the end parts of the heads 31A, 31B arranged in a row in the paper width direction coincide. Specifically, the position in the paper width direction of a nozzle at the end part of the downstream-side head 31A is equivalent to the position in the paper width direction of a corresponding nozzle at the end part of the upstream-side head 31B. For example, the leftmost nozzles, nozzles No. 1, of the downstream-side head 31A and the eighth nozzles from the right, nozzles No. 351, of the upstream-side head 31B have an equivalent position in the paper width direction; and the eighth nozzles from the left, nozzles No. 8, of the downstream-side head 31A and the rightmost nozzles, nozzles No. 358, of the upstream-side head 31B have an equivalent position in the paper width direction. The rightmost nozzles, nozzles No. 358, of the downstream-side head 31A and the eighth nozzles from the left, nozzles No. 8, of the upstream-side head 31B have an equivalent position in the paper width direction; and the eighth nozzles from the right, nozzles No. 351, of the downstream-side head 31A and the leftmost nozzles, nozzles No. 1, of the upstream-side head 31B have an equivalent position in the paper width direction.

Thus arranging the heads 31 on the head unit 30 makes it possible to arrange the nozzles in a row at equal intervals (720 dpi) across the full extent in the paper width direction. As a result, it is possible to form dot columns in which dots are arranged in a row at equal intervals (720 dpi) across the extent of the paper width direction.

Figure 3:
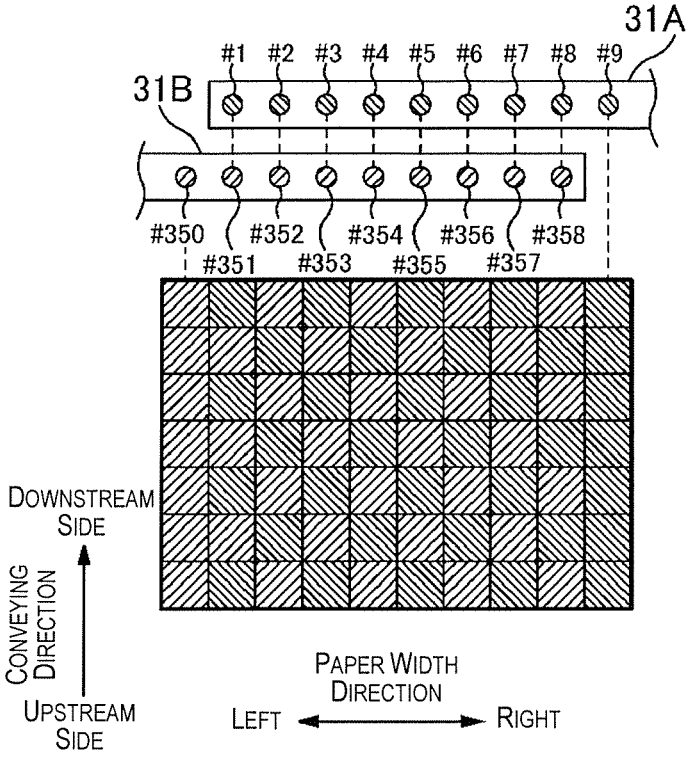
FIG. 3 is used to illustrate pixels in which dots are formed by the nozzles of the head unit.

FIG. 3 is a drawing used to illustrate pixels in which dots are formed by the nozzles of the head unit. The drawing shows a nozzle column of the upstream-side head 31B and a nozzle column of the downstream-side head 31A. Pixels in which dots are formed are shown as cells under the nozzles. In the drawing, the direction of hatching drawn on each of the nozzles coincides with the direction of hatching drawn on pixels in which each of the given nozzles forms a dot. As shown in the drawing, in the overlapping region, forming of dots is apportioned between two nozzle columns.

<Print Data Creation Process for Comparative Example>

Figure 4:
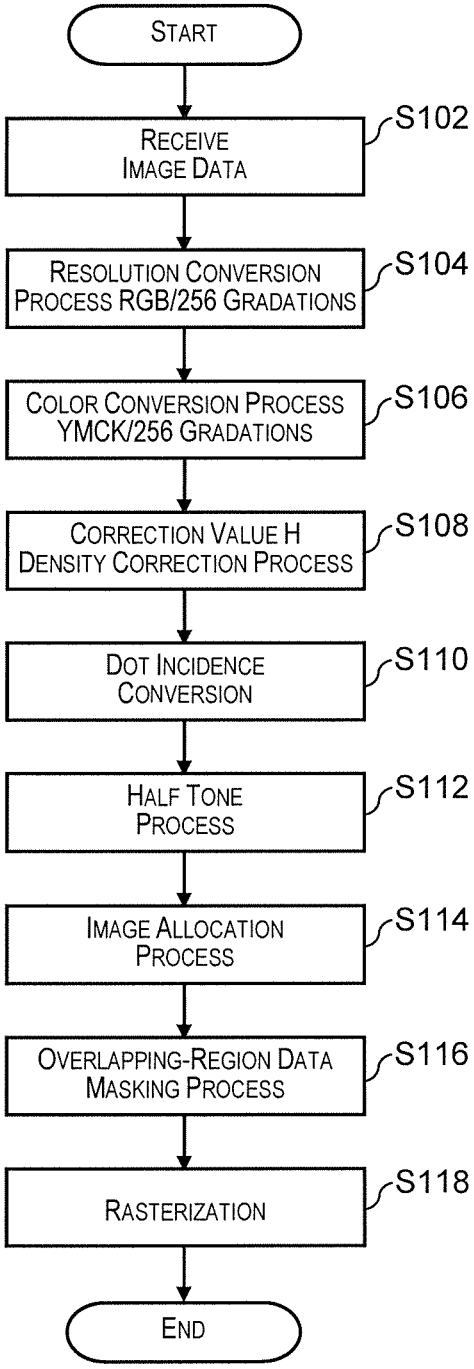
FIG. 4 is a flow chart showing a print data creation process for a comparative example.
Figure 5:
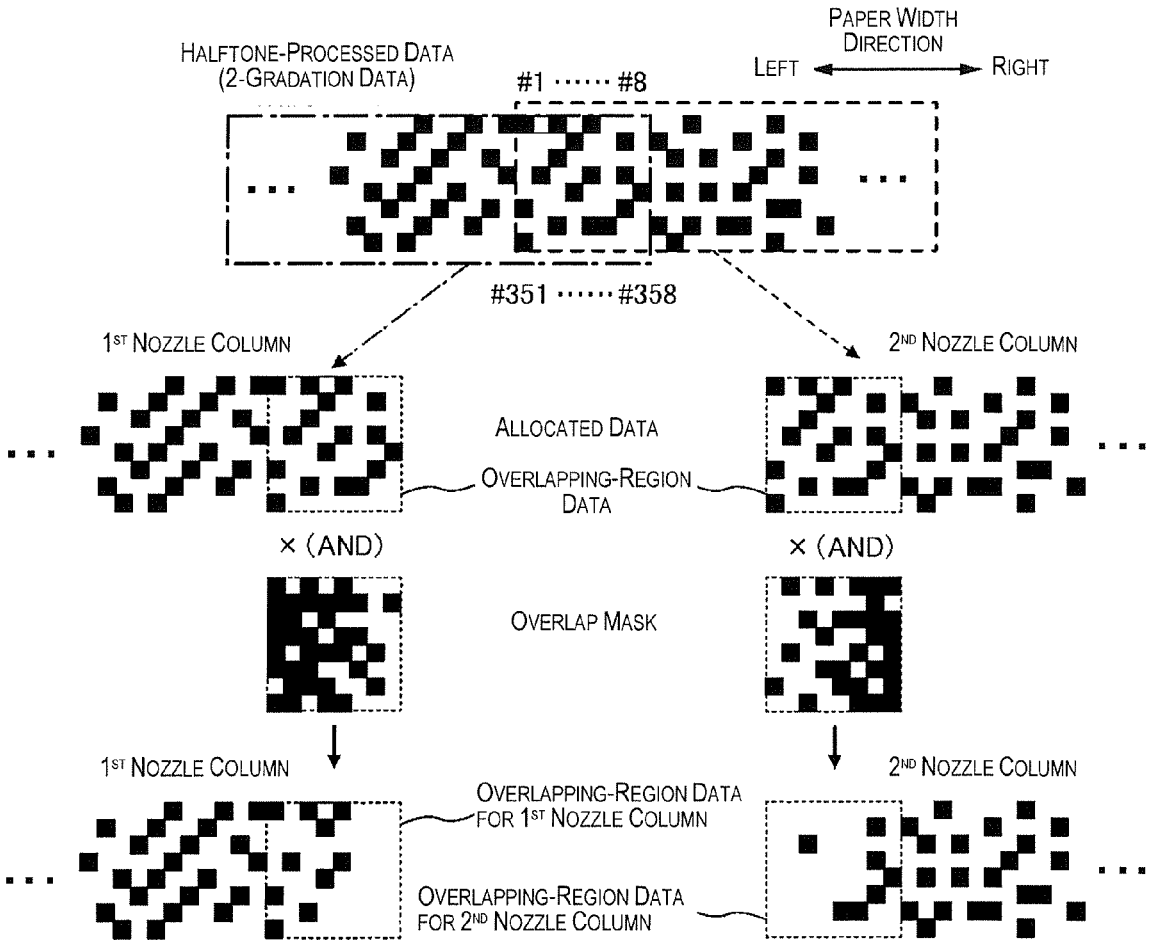
FIG. 5 shows a scheme of assigning post-halftone-process data corresponding to the overlapping region to a nozzle column of the upstream-side head 31B and a nozzle column of the downstream-side head 31A.
Figure 6:
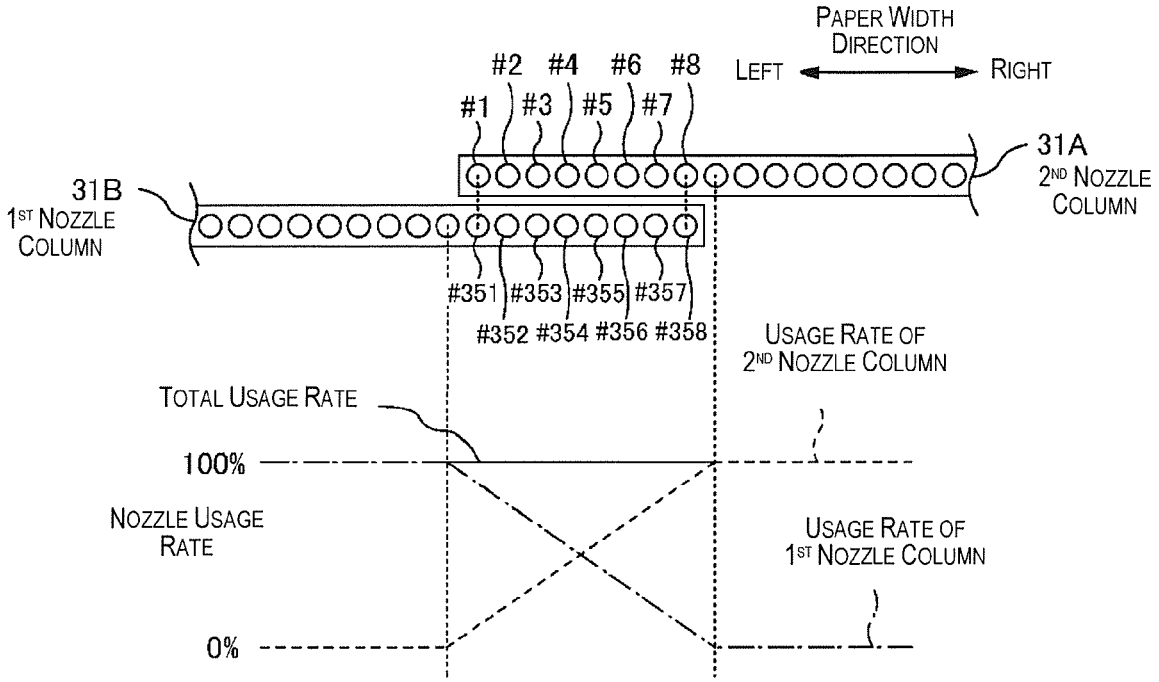
FIG. 6 shows the usage rate of the first nozzle column and the second nozzle column.

FIG. 4 is a flow chart showing a print data creation process for a comparative example. FIG. 5 shows a scheme of assigning post-halftone-process data corresponding to the overlapping region to a nozzle column of the upstream-side head 31B (hereafter referred to as "first nozzle column") and a nozzle column of the downstream-side head 31A (hereafter referred to as "second nozzle column"). FIG. 6 shows the usage rate of the first nozzle column and the second nozzle column. A description will now be given for a process of creating print data (comparative example) for implementing a printing method of the comparative example.

In the printing method of the comparative example, a dot to be formed in the overlapping region in order to obtain a desired image density is invariably formed, the dot being formed by an overlapping nozzle of either the first nozzle column (upstream-side head 31B) or the second nozzle column (downstream-side head 31A). For example, as shown in FIG. 3, in an instance in which the image data indicates that a dot is to be formed on all pixels linked to the overlapping region, a dot is formed by an overlapping nozzle of either the first nozzle column or the second nozzle column in all of the pixels. A process of creating print data for performing printing of such description will now be shown. In this instance, it is assumed that the print data is created by a printer driver installed in the computer 50 connected to the printer 1.

As shown in FIG. 4, the printer driver, upon receiving image data from a variety of application programs (S102), performs a resolution conversion process (S104). The resolution conversion process is a process for converting the image data received from a variety of application programs so as to yield a resolution used when printing is performed on the medium S. The image data after the resolution conversion process is RGB data of 256 gradations (high gradation) represented by an RGB color space. Therefore, the printer driver then converts, in a color conversion process, the RGB data into YMCK data corresponding to the inks in the printer (S106). Then, in an instance in which a density unevenness correction value H has been set in the printer 1, the printer driver corrects the YMCK data (input gradation value) in 256 gradations according to the density unevenness correction value H (S108).

Next, the printer driver performs a dot incidence rate conversion process (S108).

Figure 7:
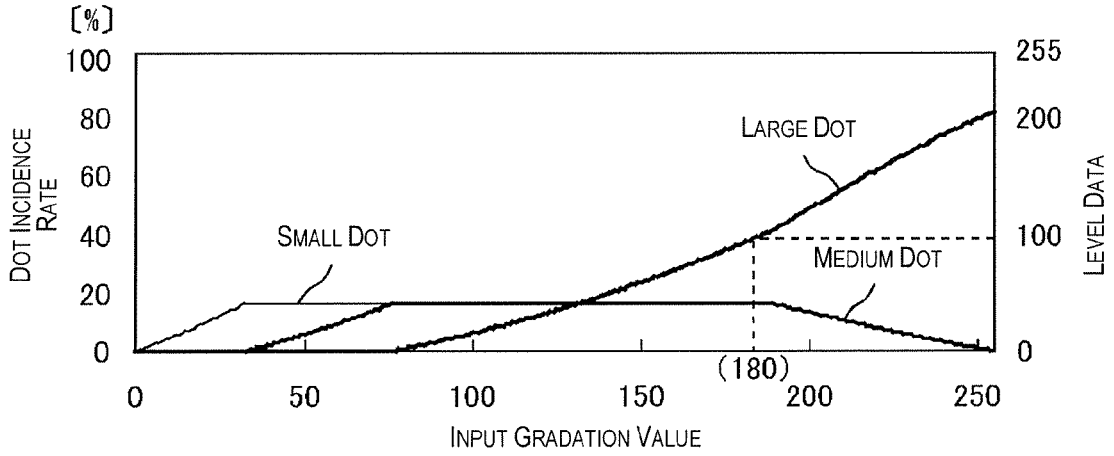
FIG. 7 shows a dot incidence rate conversion table.

FIG. 7 shows a dot incidence rate conversion table. In the dot incidence rate conversion process, the printer driver performs a conversion in which the gradation value in each of the pixels is referenced against the dot incidence rate conversion table, and the dot size and the incidence rate at which the dot is to be produced is determined. For example, in an instance in which the input gradation value (can be referred to simply as "gradation value" hereafter) is 180, it can be seen that a large dot is to be produced. It can also be seen that the incidence rate of the large dot is approximately 40%. Also, the drawing shows level data corresponding to the dot incidence rate. Specifically, the level data can be regarded to be the dot incidence rate derived using 256 levels. It can be observed from FIG. 7 that a dot incidence rate of approximately 40% corresponds to a level data of 100.

There is also a region in which there is a switch between a large dot and a medium dot (input gradation values 75 through 255) and a region in which there is a switch between a medium dot and a small dot (input gradation values 0 through 255) when gradation value referencing has been performed; in such an instance, only a dot having a larger size is selected. Thus, a dot having one of the sizes is selected for each of the pixels, and level data (a dot incidence rate) for the corresponding size is obtained.

Next, the printer driver performs a halftone process (S110). In the halftone process, a dither mask (also known as a dither matrix) is applied, a comparison is made between the level data mentioned above and cell values in the dither mask, and, in an instance in which level data that is larger than a cell value is present, it is determined that a corresponding dot is to be formed. Meanwhile, in an instance in which level data that is equal to or less than a cell value is present, it is determined that a corresponding dot is not to be formed. This halftone process makes it possible to obtain data indicating whether or not a dot is to be produced in each of the pixels in relation to every dot size.

Next, in an image allocation process (S114), the printer driver allocates halftone-processed data to the overlapping nozzles (Nos. 351 through 358) of the first nozzle column and the overlapping nozzles (Nos. 1 through 8) of the second nozzle column. This allocation is performed with respect to every dot size.

The upper drawing in FIG. 5 shows data indicating whether or not large dots are to be produced after halftone processing. A black cell represents a pixel in which a large dot is to be formed, and a white portion represents a pixel in which a large dot is not to be formed. Data of such description is also produced in relation to small dots and to medium dots by the above process. Data enclosed by dashed-dotted lines is halftone-processed data to be assigned to the first nozzle column, and data enclosed by dotted lines is halftone-processed data to be assigned to the second nozzle column. Halftone-processed data enclosed in an overlapping manner is halftone-processed data corresponding to the overlapping region.

The second drawing from the top in FIG. 5 shows data allocated by the printer driver to the first nozzle column and the second nozzle column. Therefore, if the data shown in the second drawing from the top in FIG. 5 is used without further processing, dots formed by the overlapping nozzles of the first nozzle column and dots formed by the overlapping nozzles of the second nozzle column will all be formed in a superimposed manner. Therefore, the printer driver establishes whether dots represented by the overlapping-region data (halftone-processed data) are to be formed by the overlapping nozzles of the first nozzle column or formed by the overlapping nozzles of the second nozzle column. For this purpose, a masking process (S116) is performed using an overlap mask shown in the third drawing from the top in FIG. 5.

The masking process is performed by obtaining a logical conjunction with respect to the overlap mask. Specifically, in an instance where, among the pixels, there is an overlapping of a pixel represented in black as allocation data and a pixel in the overlap mask represented by black, a large dot is produced in this pixel. The overlap mask used in such instances is produced according to nozzle usage rates shown in FIG. 6, and is a mask that results in fewer dots being produced nearer to the end part of each of the nozzle columns.

When the masking process (S116) has thus been performed on the overlapping-region data to specify dots in pixels to be formed by each of the nozzle columns, the printer driver then performs a rasterization process to rearrange the matrix-shaped image data in a sequence designated for transfer to the printer 1 (S118). Data that has been subjected to the processes described above is transmitted, along with command data corresponding to a printing method, to the printer 1 by the printer driver. The printer 1 performs printing on the basis of the received print data.

It is thus possible to perform printing including an overlapping region, on the basis of the obtained print data. However, according to the processes described above, a single dot is formed on each individual pixel. In an instance in which the medium is not conveyed in proper alignment, a dot can be formed at a position that is different from a position at which the dot was originally intended to be formed. In such an instance, the head on the downstream side will form a dot on top of a dot formed by the head on the upstream side, while there will be produced a pixel in which no dot is formed by either of the heads. Such a displacement in the ink landing position in the overlapping region in which the heads overlap reduces density or otherwise reduces image quality. Therefore, through embodiments described below, any decrease in image quality is minimized, even in an instance in which a displacement occurs in the landing position of ink.

First Embodiment

Figure 8:
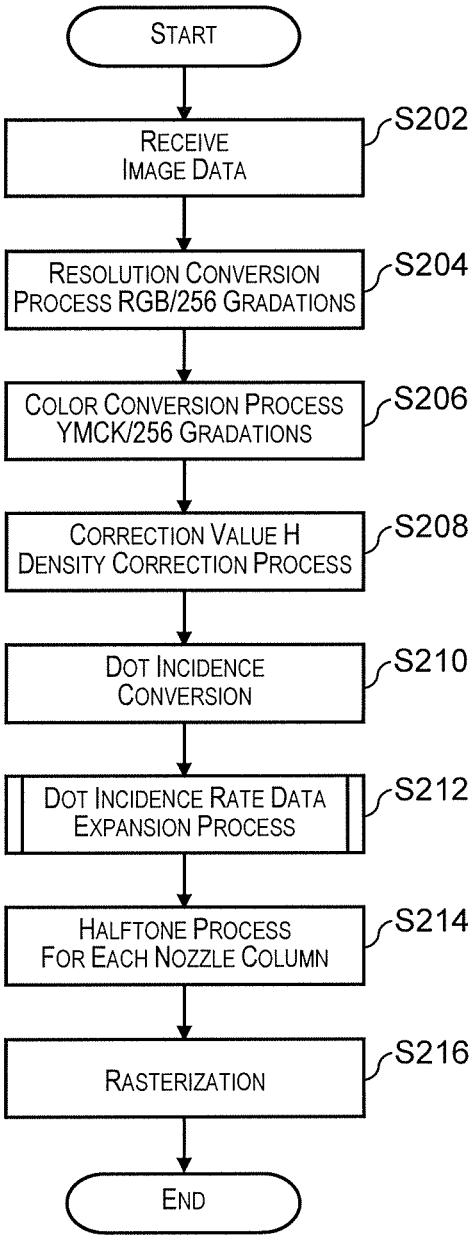
FIG. 8 is a flow chart showing creation of print data according to the present embodiment.

FIG. 8 is a flow chart showing creation of print data according to the present embodiment. Upon receiving image data from an application software (S202), the printer driver in the computer 50 connected to the printer 1 performs a resolution conversion process (S204), a color conversion process (S206), a density correction process (S208; described in detail further below), and a dot incidence rate conversion (S210), as with the process of creating the print data according to the comparative example.

Next, the printer driver performs a dot incidence rate data expansion process (S212).

Figure 9:
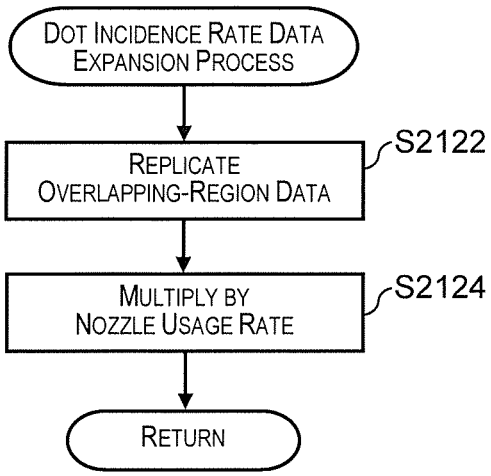
FIG. 9 is a flow chart showing the dot incidence rate data expansion process.

FIG. 9 is a flow chart showing the dot incidence rate data expansion process. In the dot incidence rate data expansion process, first, data for the overlapping region is replicated (S2122).

Figure 10:
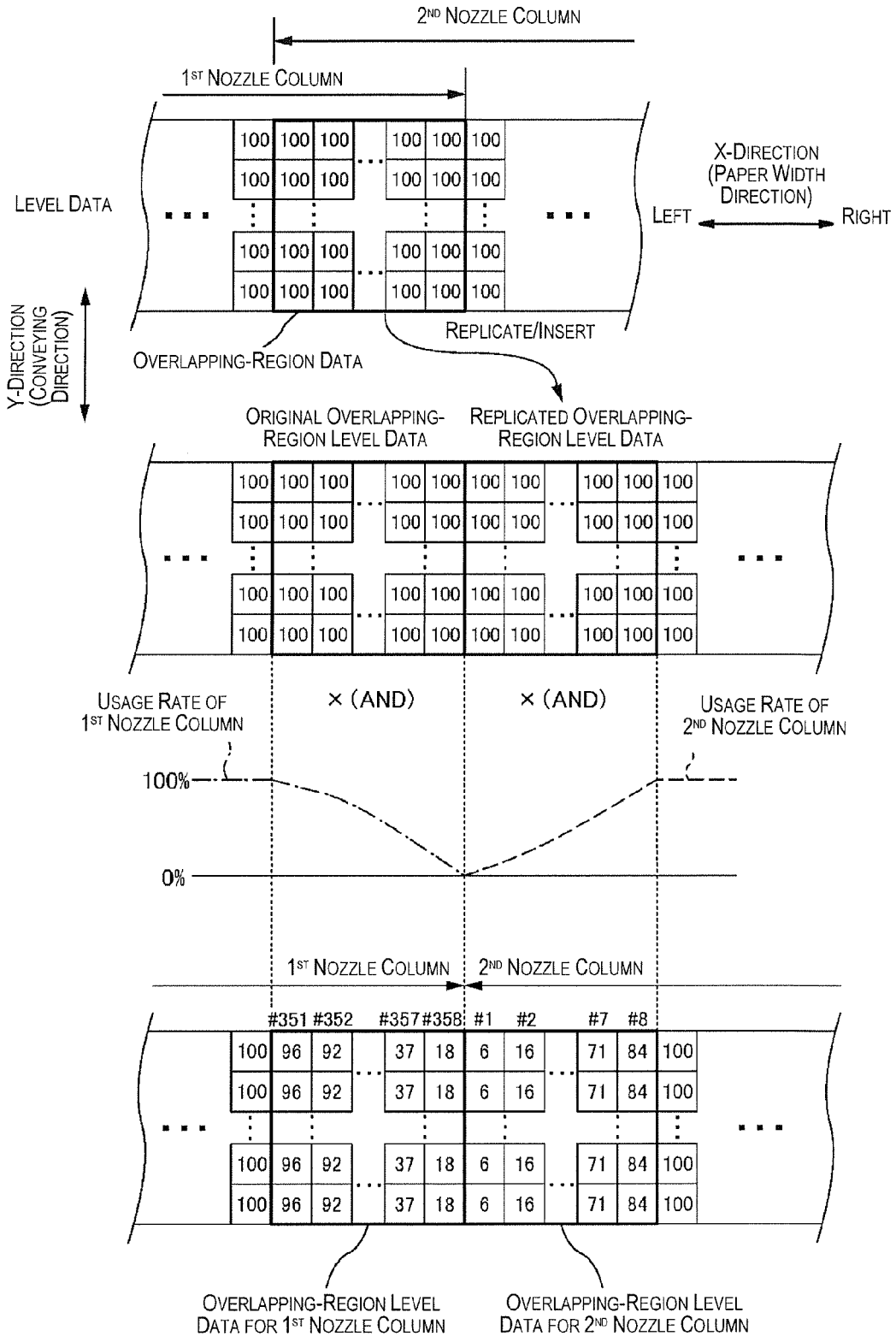
FIG. 10 shows a scheme wherein the data for the overlapping region are replicated and the overlapping-region data are multiplied by the usage rate of each of the nozzle column.

FIG. 10 shows a scheme wherein the data for the overlapping region are replicated and the overlapping-region data are multiplied by the usage rate of each of the nozzle column. The upper part of FIG. 10 shows the incidence rate in the level data obtained in the aforementioned dot incidence rate conversion (S210).

This drawing shows the level data for large dots linked to the first nozzle column (nozzle column of the upstream-side head 31B) and the second nozzle column (nozzle column of the downstream-side head 31A). Each grid cell in the drawing corresponds to one pixel. A number shown in each of the pixels is the level data for large dots for the pixel.

Here, in order to facilitate the description, only the level data corresponding to the incidence rate of large dots is shown in corresponding pixels. However, through the dot incidence rate conversion, those corresponding to small dots and medium dots are also produced. Also, in order to further facilitate the description, the level data for a large dot in each of the pixels is shown as 100 for all pixels.

Pixels (data) enclosed by bold lines is overlapping-region data corresponding to the overlapping region in which the first nozzle column and the second nozzle column overlap. A direction in the drawing corresponding to the paper width direction is defined as the x-direction, and a direction corresponding to the conveying direction is defined as the y-direction. The printer driver replicates the overlapping-region data. The results are data shown second from the top in FIG. 10. Two sets of the overlapping-region data are arranged next to each other in the x-direction Next, the printer driver multiplies the two sets of the overlapping-region data by the usage rate of each of the nozzle columns (S2124). The data shown in the lowermost part of FIG. 10 is the result of multiplying the overlapping-region data by the usage rate of each of the nozzle columns.

The nozzle usage rate in the present embodiment is varied according to the position of the overlapping nozzle. As shown in the third drawing from the top of FIG. 10, with regards to the usage rate of the first nozzle column, overlapping nozzles that are further towards the first nozzle column (left side) have a higher usage rate, and the usage rate gradually decreases. In contrast, with regards to the usage rate of the second nozzle column, overlapping nozzles that are further towards the first nozzle column (left side) have a lower usage rate, and the usage rate gradually increases. Adding the usage rate of the first nozzle column with the usage rate of the second nozzle column results in a total usage rate of 100% or greater.

For example, a pixel (column) furthest to the left in the original overlapping-region data is data allocated to nozzle No. 351 of the first nozzle column, and a pixel (column) furthest to the left in the replicated overlapping-region data is data allocated to nozzle No. 1 in the second nozzle column. The usage rate of nozzle No. 351 of the first nozzle column is taken to be 96%, the usage rate of nozzle No. 1 of the second nozzle column is taken to be 6%, and the level data of a pixel before allocation is taken to be 100%. In such an instance, as shown in the lowermost part of FIG. 10, the level data allocated to nozzle No. 351 of the first nozzle column is 96, and the level data allocated to nozzle No. 1 of the second nozzle column is 6.

When a process of multiplying the nozzle usage rate (S2124) is thus complete, a halftone process (S214) is performed on each nozzle column.

FIG. 11A shows a dithering mask, and FIG. 11B shows a scheme of the halftone process performed by dithering. Dithering is a method in which it is determined, on the basis of the magnitudes of a threshold recorded in a dither mask and the level data indicated by each of the pixels, whether or not to form a dot. According to the dithering method, dots can be generated, at a density that corresponds to the level data indicated by the pixels, for each unit region to which a single dither mask is assigned. Also, according to the dithering method, the threshold of the dither mask can be set so that dots are generated in a dispersed manner, and the graininess of the image can be improved.

FIG. 11B shows the positioning where a dither mask (bold line) is linked in data for the non-overlapping-region and data for the overlapping-region of first nozzle column and the second nozzle column. The printer driver links a dither mask, in sequence from the left side in the x-direction and the upper side in the y-direction, in the level data having a high gradation (256 gradations); compares a pixel in question and a corresponding dither mask threshold; and determines whether or not to form a large dot. When the printer driver has completed determining whether or not to form dots for a block of 256 pixels×256 pixels in the top left of the two-dimensional level data, the printer driver determines whether or not to form dots on a block of 256 pixels×256 pixels on the right side of the pixels for which the determining has already been completed. Thus, when the printer driver completes the determining of whether or not to form dots across the full extent of the two-dimensional level data in the x-direction, the printer driver then determines whether or not to form dots on pixels lower than the $256^{th}$ pixel from the top in the y-direction.

FIG. 11B shows the position of a dither mask linked to 256 pixels in each of the x-direction and the y-direction from a pixel positioned second from the left and first from the top (i.e., a pixel corresponding to nozzle No. 352), in the overlapping-region data for the first nozzle column. The printer driver compares, e.g., the threshold of 1 at the top left of the dither mask and the level data value of 92 indicated by a corresponding pixel. In such an instance, the printer driver determines that a large dot is to be formed because the level data indicated by the pixel is larger than the threshold.

Although the description above relates to large dots, it shall be apparent that a similar process is performed in relation to small dots and medium dots. Although the dither mask shown in FIG. 11A is configured from 256 pixels×256 pixels, a dither mask of 16 pixels×16 pixels can also be used. Although a description above relates to a method in which a normal dither mask is used to perform the halftone process, a variation-minimizing dither mask is preferably used as the dither mask (dither matrix) used in the present embodiment. Even in an instance in which a variation-minimizing dither mask of such description is used, the method for performing the halftone process is similar to that described above.

Last, rasterization (S216) is performed. The rasterization is similar to that according to the aforementioned comparative example. Data that has been subjected to the processes described above is transmitted, along with command data corresponding to a printing method, to the printer 1 by the printer driver. The printer 1 performs printing on the basis of the received print data.

As described above, in the present embodiment, the sum of the nozzle usage rate of the first nozzle column and the nozzle usage rate of the second nozzle column is set so as to exceed 100 in the overlapping region. Each value of the overlapping region level data for the first nozzle column and each value of the overlapping region level data for the second nozzle column thereby increase, and there is an increased possibility of it being determined, through a comparison with the value of the dither mask, that a dot is to be formed. There will be produced a pixel, in relation to the pixels in the overlapping region, in which a dot formed by the first nozzle column and a dot formed by a second nozzle column are formed in a superimposed manner. Accordingly it is possible to reduce the likelihood of there being generated a pixel in which a dot is not formed, even in an instance in which the medium is not conveyed in proper alignment. In other words, even in an instance in which there is a displacement in the landing position of the fluid in the region in which the nozzle columns overlap, it is possible to reduce the likelihood of a white spot or other color unevenness being generated, and to minimize any decrease in image quality.

Also, the method such as one described above obviates the need to perform a masking process after the halftone process as with the comparative example. The halftone process is performed after multiplying the level data by the nozzle usage rate in relation to each of the first nozzles and the second nozzles; therefore, it is possible to minimize any degradation in the graininess in the region in which the heads overlap. Also, since a variation-minimizing dither mask such as one described further below is used during the halftone process, it is possible to minimize any fluctuation in the dot incidence amount in each of the raster lines.

Figure 12:
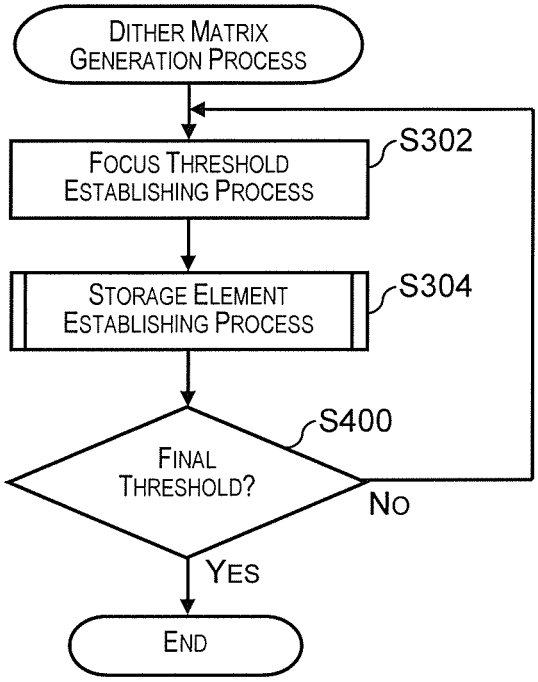
FIG. 12 is a flow chart showing a process routine of a method for producing the dither matrix used in the present embodiment.

FIG. 12 is a flow chart showing a process routine of a method for generating the dither matrix used in the present embodiment. In this example, a small dither matrix having 10 rows and 10 columns is produced in order to facilitate understanding of the description. A graininess index (described further below) is used to evaluate the optimality of the dither matrix.

A focus threshold establishing process is performed in step S302. The focus threshold establishing process is a process for establishing a threshold used to establish an element to be stored. In the present embodiment, the threshold is established by selecting in sequence starting from a threshold having a relatively small value, i.e., a threshold having a value at which a dot is more readily formed. This is because when selection is performed in sequence starting from a threshold for which a dot is more readily formed, the element to be stored is thus locked in sequence from a threshold controlling the arrangement of dots in a highlight region in which the graininess of the dots is more prominent, making it possible to obtain a greater degree of freedom of design for the highlight region in which the graininess of the dots is more prominent.

In step S304, a storage element establishing process is performed. The storage element establishing process is a process for establishing an element in which the focus threshold is to be stored. The focus threshold establishing process (step 302) and the storage element establishing process (step S304) is alternately repeated, whereby the dither matrix is produced. The above processes can be applied to all of the thresholds or some of the thresholds.

Figure 13:
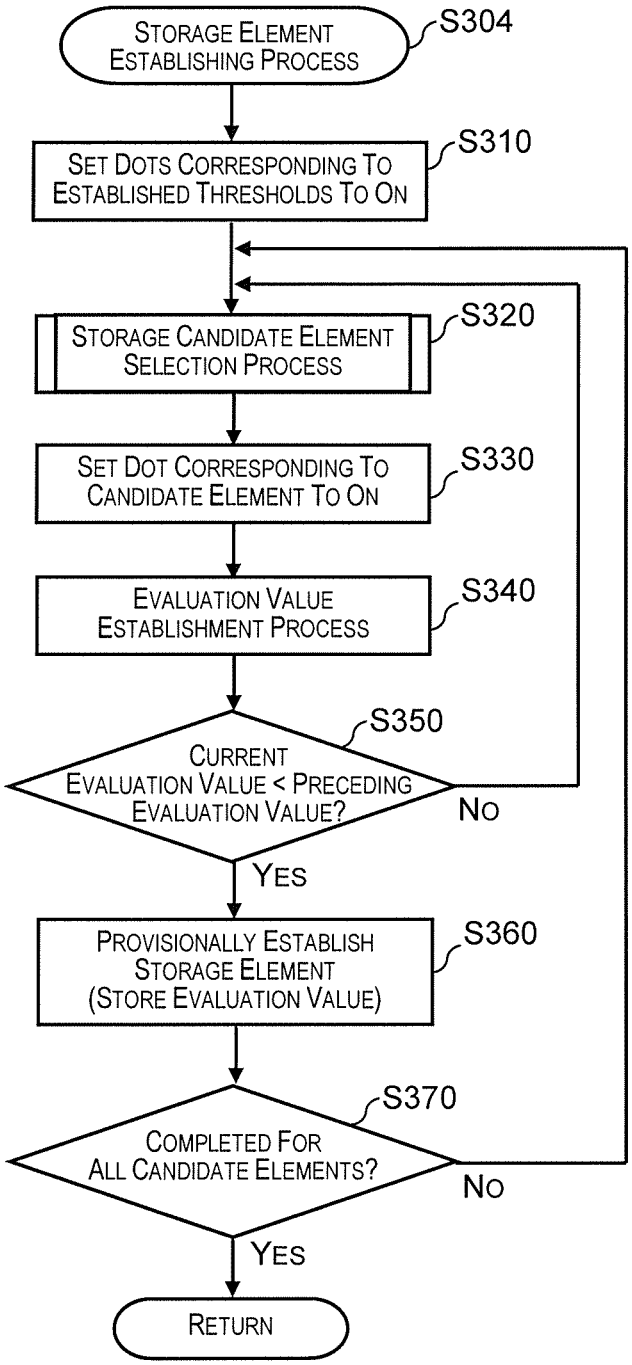
FIG. 13 is a flow chart showing a process routine of the storage element establishing process.

FIG. 13 is a flow chart showing a process routine of the storage element establishing process. In step S310, dots corresponding to established thresholds are set to ON. An established threshold refers to a threshold for which a storage element, in which the focus threshold is to be stored, has been established. As described above, in the present embodiment, a selection is made in sequence starting from a threshold having a value at which a dot is more readily formed. Therefore, in an instance in which a dot is to be formed in relation to a focus threshold, a pixel corresponding to an element in which an established threshold has been stored will invariably have a pixel formed therein. Conversely, with regards to the smallest input gradation value at which a dot is formed in relation to the focus threshold, no dot is formed in a pixel corresponding to an element other than an element in which an established threshold has been stored.

FIG. 14 is a drawing used to illustrate a matrix MG24 showing a scheme in which the first 25 thresholds (0 through 24) for which a dot is most readily formed are stored in a matrix, and to illustrate a scheme in which a dot is formed on each of 25 pixels corresponding to those elements. A dot pattern $D_{pa}$ configured as described above is used to establish in which pixel a $26^{th}$ dot is to be formed.

In step S320, a storage candidate element selection process is performed. The storage candidate element selection process is a process for selecting a storage candidate so that the variation in the number of dots formed in a group of print pixels does not become excessively large.

Figure 15:
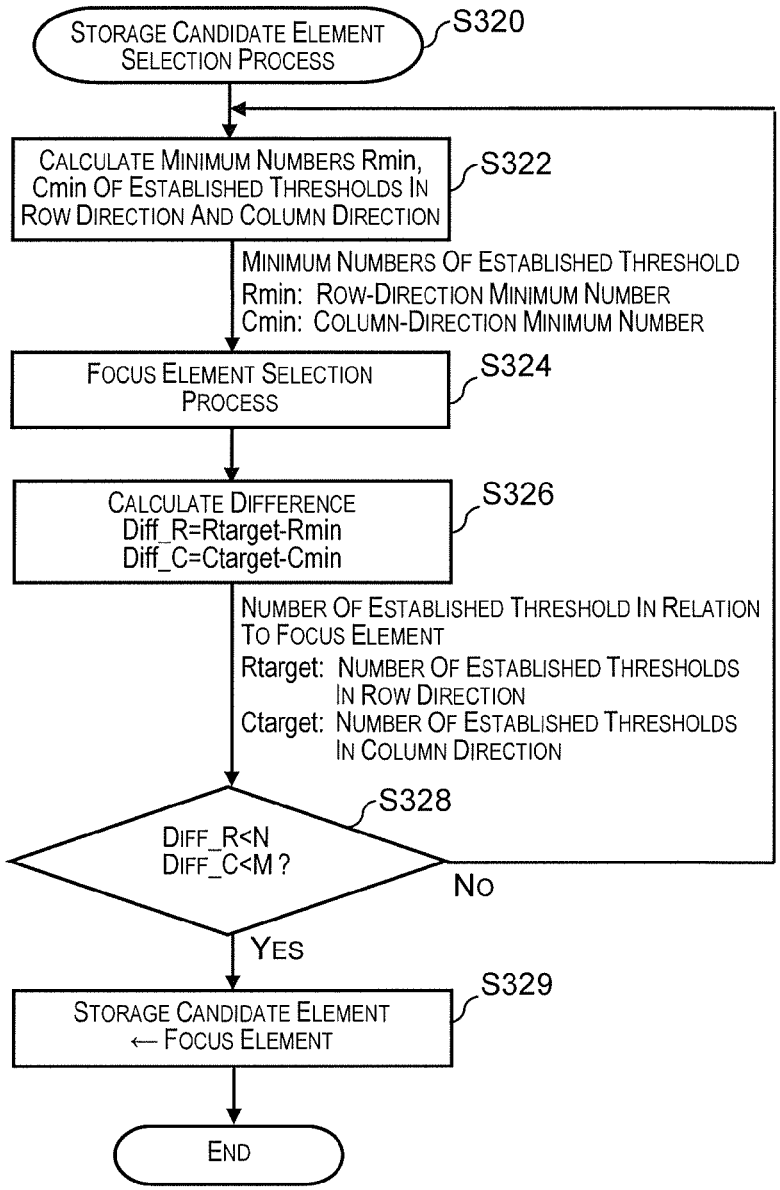
FIG. 15 is a flow chart showing a process routine of the storage candidate element selection process.

FIG. 15 is a flow chart showing a process routine of the storage candidate element selection process. In step S322, a calculation is performed for a row-direction minimum number Rmin, which is a minimum number of established thresholds in the row direction of the dither matrix M, and a column-direction minimum number $C_{min}$, which is a minimum number of established thresholds in the column direction.

Figures 16, 17:
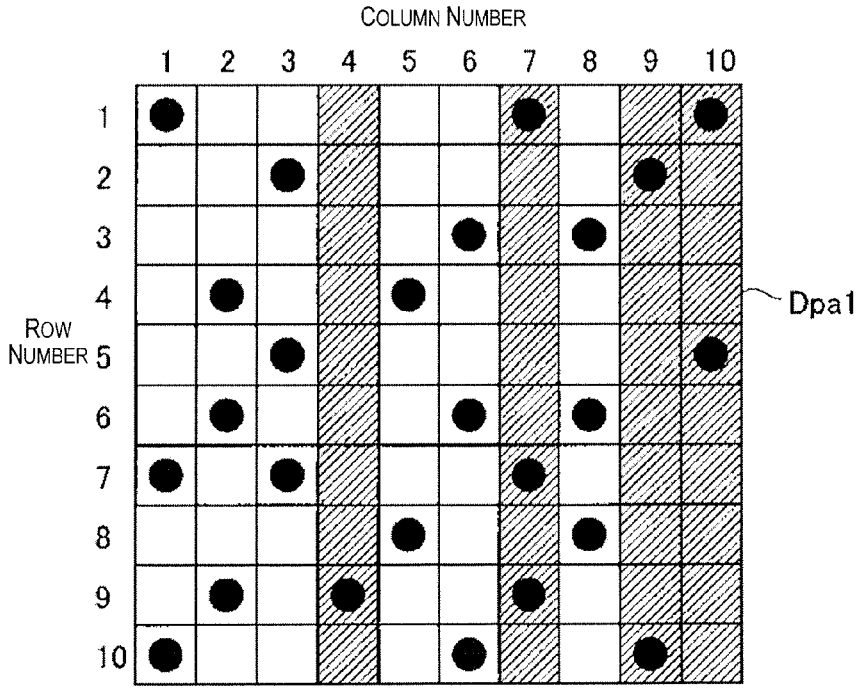
FIG. 16 is a drawing illustrating the number of row-direction established thresholds and the number of column-direction established thresholds.
FIG. 17 is a drawing used to illustrate a state in which a dot corresponding to the storage candidate element and dots corresponding to the established thresholds have been set to ON (dot pattern $D_{pa1}$)

FIG. 16 is a drawing illustrating the number of row-direction established thresholds and the number of column-direction established thresholds. As can be seen from FIG. 16, for example, three thresholds, namely thresholds 17, 19, 12, are stored in the elements in a first column, whereas only one threshold, namely threshold 16, is stored in the elements in a fourth column. Meanwhile, three thresholds, namely thresholds 17, 7, 14, are stored in the elements in a first row, and two thresholds, namely thresholds 1, 24, are stored in the elements of a second row. On the basis of the numbers of established thresholds such as those described above, the number of thresholds in the fourth column, i.e., 1, is established as the column-direction minimum number $C_{min}$, and the number of thresholds in the second row and other rows, i.e., 2, is established as the row-direction minimum number $R_{min}$.

In step S324, a focus element selection process is performed. The focus element selection process is a process for selecting, in a predetermined sequence, storage elements in which no established threshold has been stored. In the present embodiment, selection is performed column-by-column in sequence from the first column. For example, for the first focus element, an element affixed with "*1" in row 1, column 2 is selected as a focus element. Then, an element in row 1, column 3 (*2), and then an element in row 1, column 4 (*3), are selected in sequence, and so on.

In step S326, a difference calculation process is performed. The difference calculation process is a process for calculating a row-direction difference value Diff_R between a number $R_{target}$ of row-direction established thresholds and the row-direction minimum number $R_{min}$; and a column-direction difference value Diff_C between a number $C_{target}$ of column-direction established thresholds and the column-direction minimum number $C_{min}$, in relation to a row and a column to which the focus element belongs. For example, in an instance in which the focus element is an element in row 1, column 2, the number $R_{target}$ of row-direction established thresholds is 3, and the row-direction minimum number $R_{min}$ is 2; therefore, the row-direction difference value Diff_R is 1. Since the number $C_{target}$ of column-direction established thresholds is 3 and the column-direction minimum number $C_{min}$ is 1, the column-direction difference value Diff_C is 2.

In step S328, a judgement is made as to whether or not both of the row-direction difference value Diff_R and the column-direction difference value Diff_C are smaller than a predetermined reference value. In an instance in which the result of the judgement shows that the row-direction difference value Diff_R is smaller than a reference value N and the column-direction difference value Diff_C is smaller than a reference value M, the processing proceeds to step S329. In an instance in which either is equal to or greater than the respective reference value, the processing is returned to step S322. It can be seen that, e.g., if the two reference values N, M are both 1, for elements in row 1, column 2 and row 1, column 3, at least one of the difference values is equal to or greater than the corresponding reference value, but for the element in row 1, column 4, both of the difference values are smaller than the respective reference value.

In step S329, the focus element is substituted for a storage candidate element. Thus, an element to be selected as a storage element is only one for which the respective difference between the respective number of established thresholds in the row and the column to which the focus element belongs and the respective minimum value of the number of established thresholds in all rows and columns is smaller than the respective predetermined reference value. Specifically, irrespective of the row number, only an element belonging to the fourth, the seventh, the ninth, or the tenth columns (elements with hatching) is selected as a storage candidate element. When the process of step S329 is complete, the process is returned to step S330 (FIG. 13).

In step S330, a dot corresponding to the storage candidate element is set to ON. This process is performed so as to be additional to dots set to ON in step S310 as dots corresponding to the established thresholds.

Figures 18, 19:
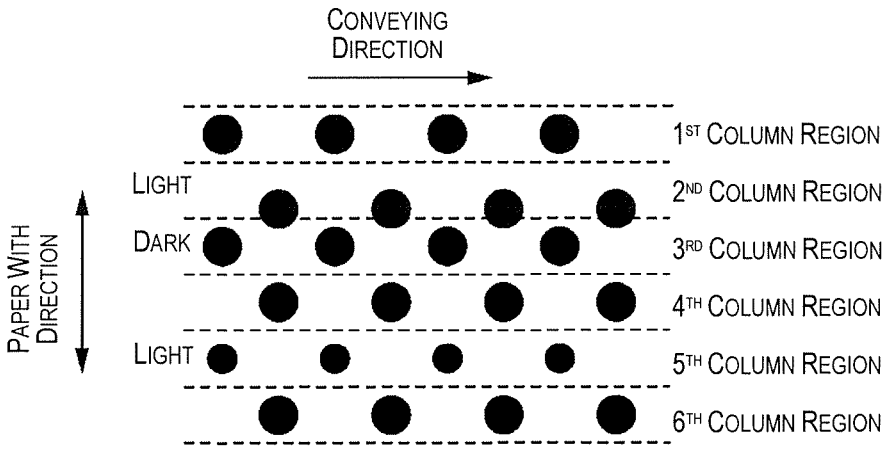
FIG. 18 is a drawing used to illustrate a matrix in which this state of dot formation has been quantified, i.e., a dot density matrix $D_{da1}$ in which dot density is quantitatively represented.
FIG. 19 is a view showing an example in which a raster line affects the density of an adjacent raster line.

FIG. 17 is a drawing used to illustrate a state in which a dot corresponding to the storage candidate element and dots corresponding to the established thresholds have been set to ON (dot pattern $D_{pa1}$). Here, the storage candidate element is the element at row 1, column 7. FIG. 18 is a drawing used to illustrate a matrix in which this state of dot formation has been quantified, i.e., a dot density matrix $D_{da1}$ in which dot density is represented in a quantitative manner. Numeral 0 signifies that no dot has been formed, and numeral 1 signifies that a dot has been formed (including an instance in which it is assumed that a dot has been formed in a storage candidate element).

In step S340, an evaluation value establishment process is performed. The evaluation value establishment process is a process for calculating a graininess index as an evaluation value on the basis of the dot density matrix (FIG. 18). The graininess index can be calculated using a formula described further below.

In step S350, the graininess index calculated on the current occasion is compared to the graininess index calculated on a preceding occasion (stored in a buffer; not shown). In an instance in which the result of the comparison shows that the graininess index calculated on the current occasion is smaller (preferable), the calculated graininess index and the storage candidate element are linked and stored (updated) in the buffer, and the storage candidate element for the current occasion is provisionally established as a storage element (step S360).

The processes described above are performed in relation to all candidate elements, and a determination is made in regard to a storage candidate element stored in the buffer (not shown) (step S370). The processes described above are performed in relation to all thresholds or to all thresholds within a range set in advance, and generation of a dither matrix is completed (step S400, FIG. 12).

Thus, the difference in the number of dots formed at each gradation value in each of the rows and each of the columns is restricted to within a predetermined range, and it is therefore possible to minimize localized unevenness in density and increase image quality. Furthermore, the present embodiment also presents a benefit in that the density error in each of the raster lines is reduced, therefore making it possible to minimize generation of banding.

Next, a description will be given for the graininess index. Using visual spatial frequency characteristics VTF, it is possible to model the human visual sensitivity as a transfer function known as the visual spatial frequency characteristics VTF, and thereby quantify the graininess of the halftone-processed dots as visually perceived by humans. A value thus quantified is known as a graininess index G.

The equation shown below shows a representative empirical formula representing the visual spatial frequency characteristics VTF.

$$VTF(u) = 5.05 \cdot \exp\left(\frac{-1.38\pi L \cdot u}{180}\right) \cdot \left\{1 - \exp\left(\frac{-0.1\pi L \cdot u}{180}\right)\right\} \quad \text{[Equation 1]}$$

In the above equation, variable L represents the observation distance, and variable u represents the spatial frequency. The above equation defines the graininess index. Coefficient K in the equation is a coefficient for synchronizing the obtained value with what is sensed by humans.

The graininess index G, in which the above equation is used, is represented by the following equation. FS represents a power spectrum obtained by performing a Fourier transform with regards to the obtained image.

$$G = K\int FS(u) \cdot VTF(u)du \quad \text{[Equation 2]}$$

From the above equation, it follows that a smaller graininess index represents superior graininess.

Next, a description will be given for a density correction process. A "pixel region" and a "column region" will now be defined for the description below. A pixel region is a region on the medium corresponding to a pixel. A column region is a region in which image regions are arranged in a row in the conveying direction, and corresponds to a plurality of pixels arranged in a row in the x-direction on the image data (hereafter referred to as a "pixel column").

FIG. 19 is a view showing an example in which a raster line is affecting the density of an adjacent raster line. In FIG. 19, the raster line formed on a second column region is formed towards a third column region due to a skew in the flight of ink droplets ejected from a nozzle. As a result, the second column region has a lighter visual appearance and the third column region has a darker visual appearance. Meanwhile, the amount of ink in the ink droplets ejected from a fifth column region is less than a designated amount, and dots formed in the fifth column region are smaller. As a result, the fifth column region becomes lighter. The density in the image is thereby caused to be uneven. Therefore, a column region that is printed lighter is corrected so as to be printed darker, and a column region that is printed darker is corrected so as to be printed lighter. Also, the darkening of the third column region is caused not by an effect of a nozzle assigned to the third column region, but by an effect of a nozzle assigned to the adjacent, second column region.

Therefore, in the density correction process, a correction value H is calculated for every column region (pixel column), taking also into account the effect of an adjacent nozzle. The correction value H can be calculated for every model of the printer 1 during a process of manufacturing the printer 1 or during maintenance of the printer 1. In the present description, the correction value H is calculated according to a correction-value-obtaining program installed in the computer 50 connected to the printer 1. A description will now be given for a specific method for calculating a correction value for every column region.

Figure 20:
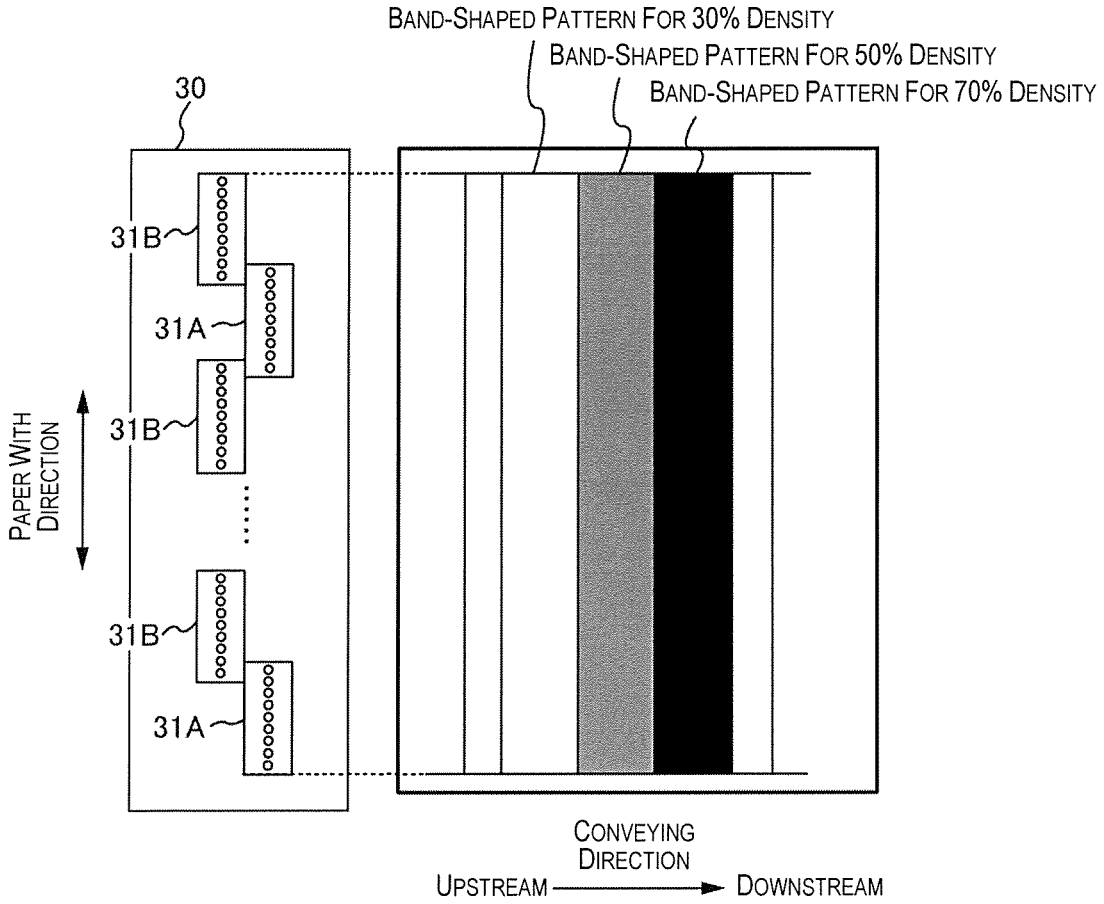
FIG. 20 shows a test pattern.

FIG. 20 shows a test pattern. The correction-value-obtaining program first causes the printer 1 to print a test pattern. The drawing shows a corrective pattern formed by one of the nozzle columns from among the nozzle columns (YMCK) provided to each of the heads 31. A corrective pattern is printed as a test pattern for every nozzle column (YMCK).

The corrective pattern is configured from three types of band-shaped pattern. Each of the band-shaped patterns is produced from image data having a uniform gradation value. A gradation value for forming a band-shaped pattern is referred to as a command gradation value. A command gradation value for a band-shaped pattern having a density of 30% is represented by Sa (76), a command gradation value for a band-shaped pattern having a density of 50% is represented by Sb (128), and a command gradation value of a band-shaped pattern having a density of 70% is represented by Sc (179). A single corrective pattern is configured from raster lines (column regions), the number of raster lines being equal to the number of nozzles arranged in a row in the paper width direction on the head unit 30.

In an instance in which print data for printing a corrective pattern is being created, again, a halftone process is performed on data obtained by multiplying level data for each dot size with the nozzle usage rate, as with the above-mentioned embodiment.

Figure 21:
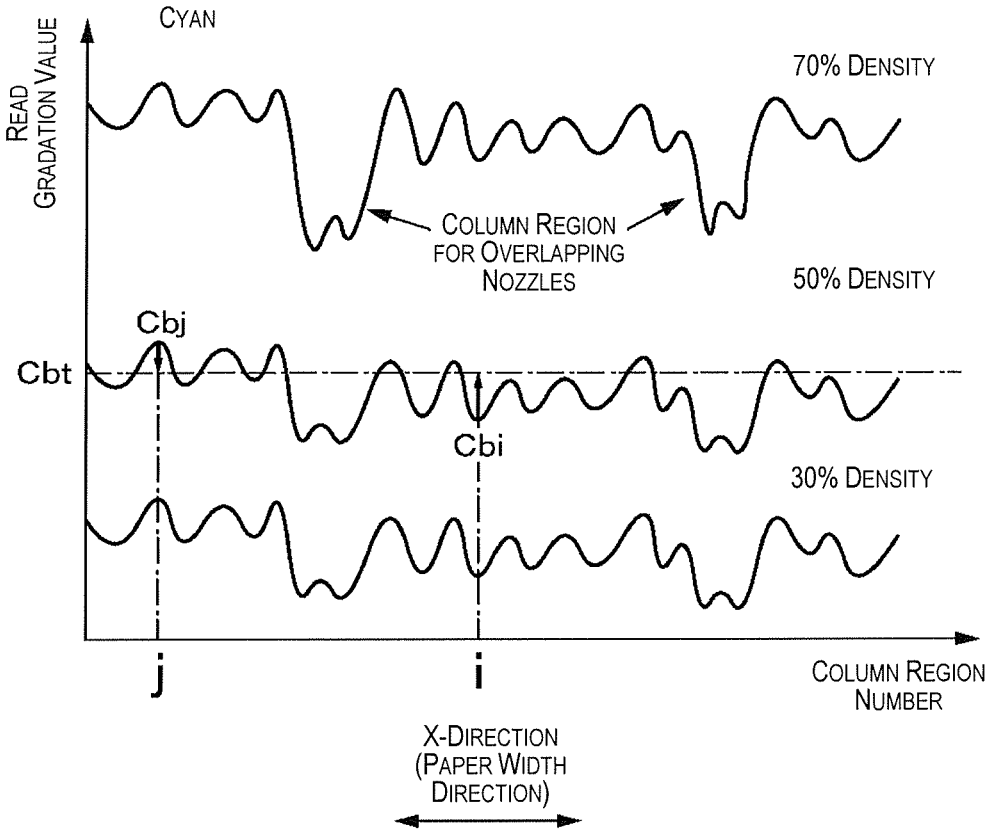
FIG. 21 is a result of reading a cyan corrective pattern using a scanner.

FIG. 21 shows a result of reading a cyan corrective pattern using a scanner. Next, the correction-value-obtaining program obtains the result of the scanner reading the test pattern. A description will now be given using read data for cyan as an example. The correction-value-obtaining program sets up a one-to-one correspondence between pixel columns in the read data and column regions forming the corrective pattern, and then calculates a density (read gradation value) of each column region for every band-shaped pattern. Specifically, an average value of read gradation values of pixels belonging to a pixel column corresponding to a certain column region is to be a read gradation value of this column region. In the graph shown in FIG. 21, the horizontal axis is the column region number and the vertical axis is the read gradation value of each of the column regions.

Even though each of the band-shaped patterns has been uniformly formed at the respective command gradation value, there is a variation in the read gradation values between column regions as shown in FIG. 21. For example, in the graph shown in FIG. 21, a read gradation value Cbi of column region i is relatively lower than read gradation values of other column regions, and a read gradation value Cbj of column region j is relatively higher than read gradation values of other column regions. Accordingly, the column region i has a lighter visual appearance and the column region j has a darker visual appearance. A variation of such description in the read gradation value of the column regions represents the density unevenness that is generated in a printed image.

Bringing the read gradation values of the column regions nearer a uniform value makes it possible to mitigate density unevenness caused by lightness in the image in the overlapping region or related to the level of precision with which the nozzle was manufactured. Therefore, an average value Cbt of read gradation values of all column regions in a single command gradation value (e.g., Sb; density 50%) is set as a target value Cb. Then, a gradation value indicated by pixel column data corresponding to each of the column regions is corrected so that the read gradation value of each of the column regions in the command gradation value Sb is brought nearer the target value Cbt.

Specifically, a gradation value indicated by pixel column data corresponding to column region i, in FIG. 21, in which the read gradation value is smaller than the target value Cbt, is corrected to a gradation value that is darker than the command gradation value Sb. A gradation value indicated by pixel column data corresponding to column region j, in which the read gradation value is greater than the target value Cbt, is corrected to a gradation value that is lighter than the command gradation value Sb. Thus, there is calculated a correction value H for correcting the gradation value of pixel column data corresponding to each of the column regions in order to bring the density of all column regions nearer a uniform value with regards to a single gradation value.

Figure 22A:
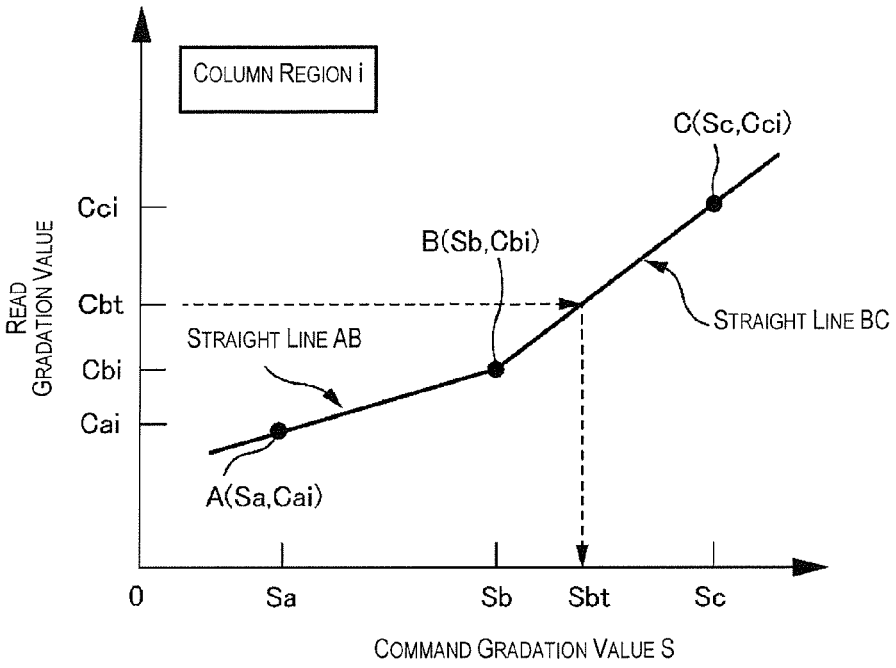
FIGS. 22A and 22B are drawings showing a specific method of calculating a density unevenness correction value H.
Figure 22B:
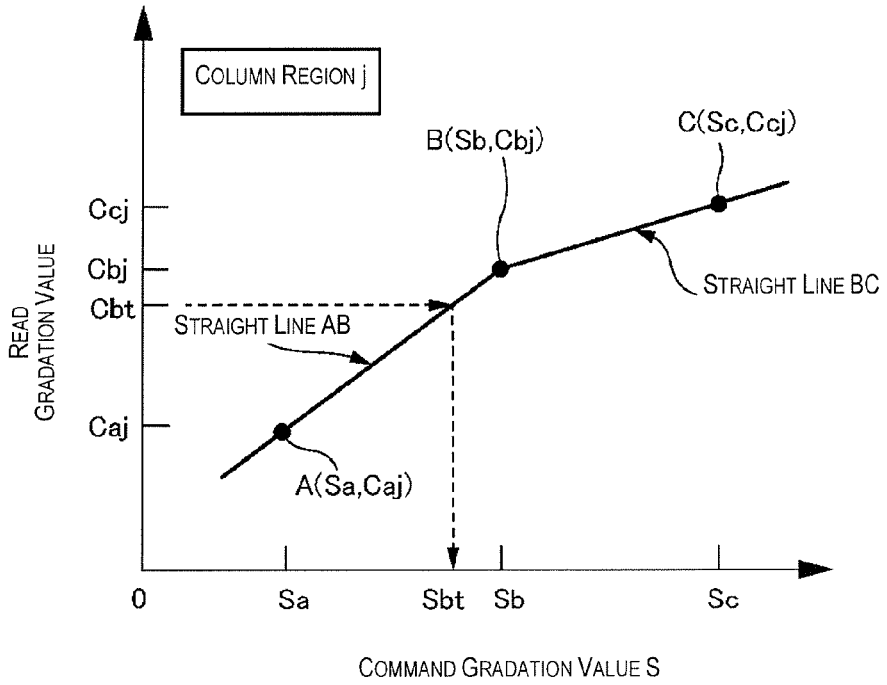

FIGS. 22A and 22B are drawings showing a specific method for calculating the density unevenness correction value H. First, FIG. 22A shows a scheme of calculating a target command gradation value (e.g., Sbt) in regard to a command gradation value (Sb) in relation to column region i in which the read gradation value is smaller than the target value Cbt. The horizontal axis represents the gradation value and the vertical axis represents the read gradation value in the test pattern result. Read gradation values (Cai, Cbi, Cci) are plotted against command gradation values (Sa, Sb, Sc). For example, a target command gradation value Sbt, at which the column region i will be represented at the target value Cbt, in relation to the command gradation value Sb is calculated using the following formula (linear interpolation based on straight line BC).

$$Sbt=Sb+\{(Sc-Sb)\times(Cbt-Cbi)/(Cci-Cbi)\}$$

Similarly, as shown in FIG. 22B, with regards to column region j in which the read gradation value is higher than the target value Cbt, a target command gradation value Sbt at which the column region j will be represented at the target value Cbt, in relation to the command gradation value Sb, is calculated using the following formula (linear interpolation based on straight line AB).

$$Sbt=Sa+\{(Sb-Sa)\times(Cbt-Caj)/(Cbj-Caj)\}$$

Thus, the target command gradation value Sbt of each of the column regions is calculated in relation to the command gradation value Sb. Then, using the following equation, a correction value Hb for cyan is calculated in relation to the command gradation value Sb of each of the column regions. Corrective values in relation to other command gradation values (Sa, Sc) and corrective values in relation to other colors (yellow, magenta, black) are also calculated in a similar manner.

$$Hb=(Sbt-Sb)/Sb$$

Figure 23:
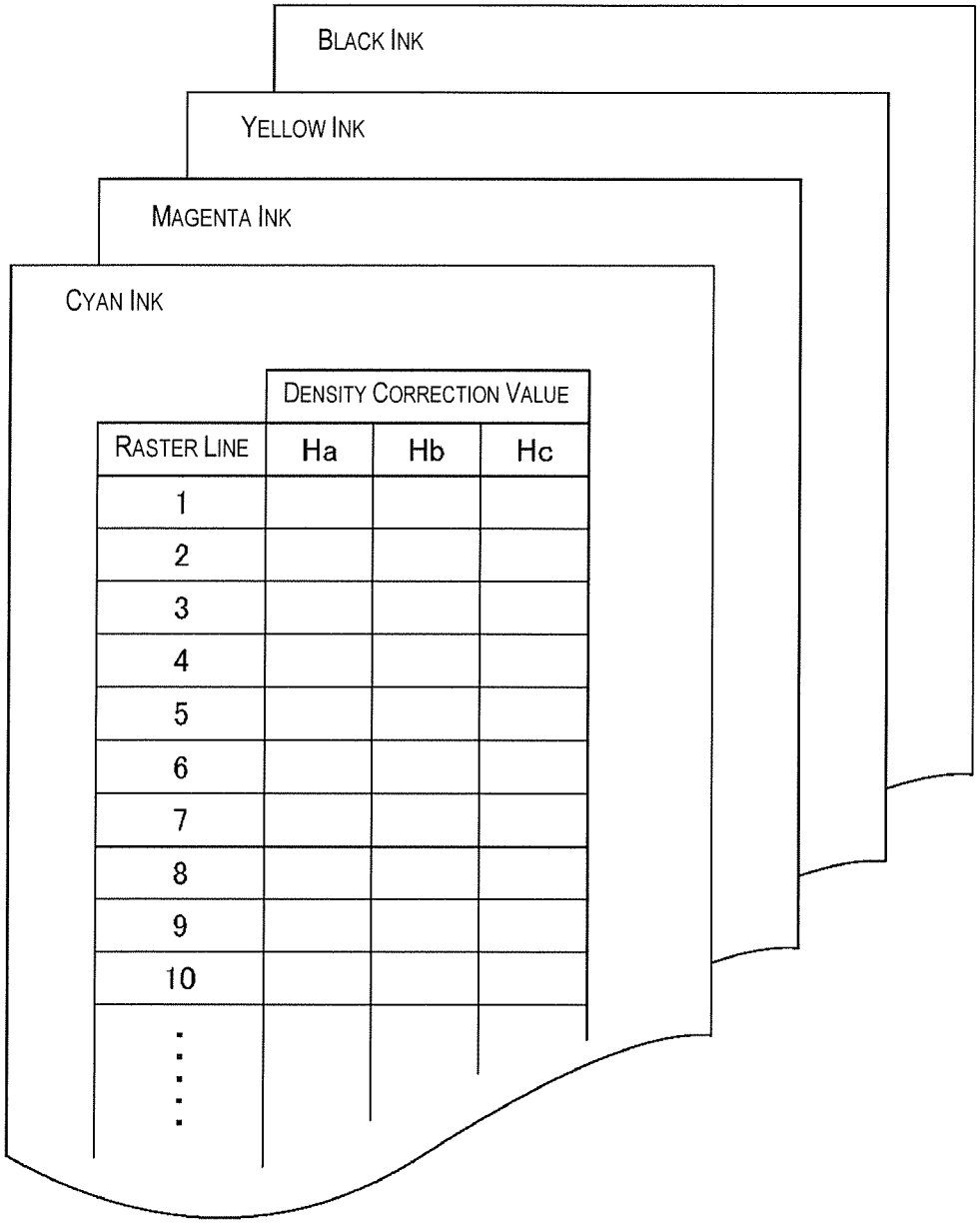
FIG. 23 shows a correction value table relating to each of the nozzle columns (CMYK)

FIG. 23 shows a correction value table relating to each of the nozzle columns (CMYK). The correction values H calculated as above are inserted into the correction value table shown. On the correction value table, correction values (Ha, Hb, Hc), each corresponding to each of the three command gradation values (Sa, Sb, Sc), are defined for every column region. The correction value table of such description is recorded in the memory device 13 of the printer 1 that printed the test pattern to calculate the correction values H. The printer 1 is subsequently delivered to a user.

When starting use of the printer 1, the user installs the printer driver into the computer 50 to be connected to the printer 1. Then, the printer driver requests the printer 1 to transmit, to the computer 50, the correction values H recorded in the memory device 13. The printer driver stores the correction values H transmitted from the printer 1 in a memory device within the computer 50.

If an uncorrected gradation value S_in is identical to any of the command gradation values Sa, Sb, Sc, it is possible to use the correction value H corresponding to each of the command gradation values, the correction value H being a correction value Ha, Hb, Hc recorded in the memory device of the computer 50. For example, if the uncorrected gradation value S_in is equal to Sc, a corrected gradation value S_out is obtained by the following equation.

$$S_out=Sc\times(1+Hc)$$

Figure 24:
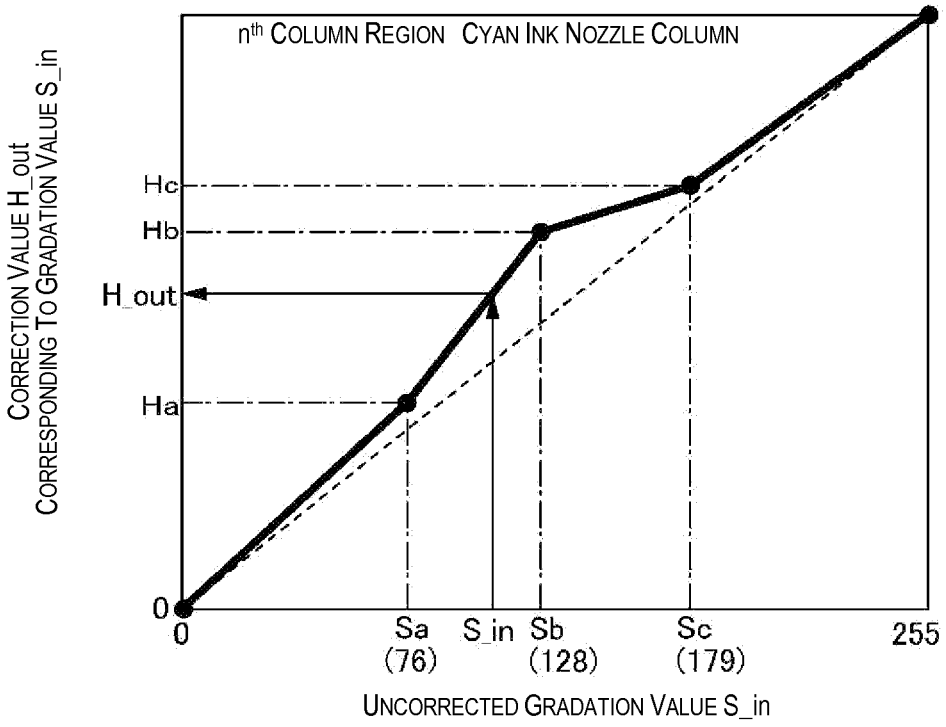
FIG. 24 shows a scheme of calculating a correction value H corresponding to each of the gradation values in relation to an $n^{th}$ cyan column region.

FIG. 24 shows a scheme of calculating a correction value H corresponding to each of the gradation values in relation to an $n^{th}$ cyan column region. The horizontal axis represents the uncorrected gradation value S_in and the vertical axis represents the correction value H_out corresponding to the uncorrected gradation value S_in. In an instance in which the uncorrected gradation value S_in is different from the command gradation value, a correction value H_out corresponding to the uncorrected gradation value S_in is calculated.

For example, if the uncorrected gradation value S_in is between command gradation values Sa and Sb as shown in FIG. 24, the correction value H_out is calculated by linearly interpolating between the correction value Ha of the command gradation value Sa and the correction value Hb of the command gradation value Sb using the following equation.

$$H_out = Ha + \{(Hb - Ha) \times (S_in - Sa)/(Sb - Sa)\}$$

$$S_out = S_in \times (1 + H_out)$$

In an instance in which the uncorrected gradation value S_in is smaller than the command gradation value Sa, the correction value H_out is calculated by linearly interpolating between a minimum gradation value 0 and the command gradation value Sa. In an instance in which the uncorrected gradation value S_in is larger than the command gradation value Sc, the correction value H_out is calculated by linearly interpolating between a maximum gradation value 255 and the command gradation value Sc.

Thus, in the density correction process (S208 in FIG. 8), the printer driver corrects, using a correction value H set for every color, every column region that the pixel data belongs to, and every gradation value, the gradation value S_in (256 gradation data) indicated by each pixel. The gradation value S_in of each pixel corresponding to a column region whose density has a lighter visual appearance is thereby corrected to a darker gradation value S_out, and the gradation value S_in indicated by each pixel corresponding to a column region whose density has a darker visual appearance is thereby corrected to a lighter gradation value S_out.

Second Embodiment

The probably of a white spot being generated in the overlapping region can differ between a low-density portion, in which the proportion of dots that are superimposed on each other is smaller, and a middle-tone portion, in which the proportion of overlapping dots is greater. Therefore, this can be solved by varying the number of dots being generated in the overlapping region according to density. Specifically, in the second embodiment, the number of dots being generated in the overlapping region is varied according to the average density of the image to be printed on the medium. More specifically, nozzle usage rates are varied according to the average density of the image, whereby the number of dots being generated is varied.

Figure 25:
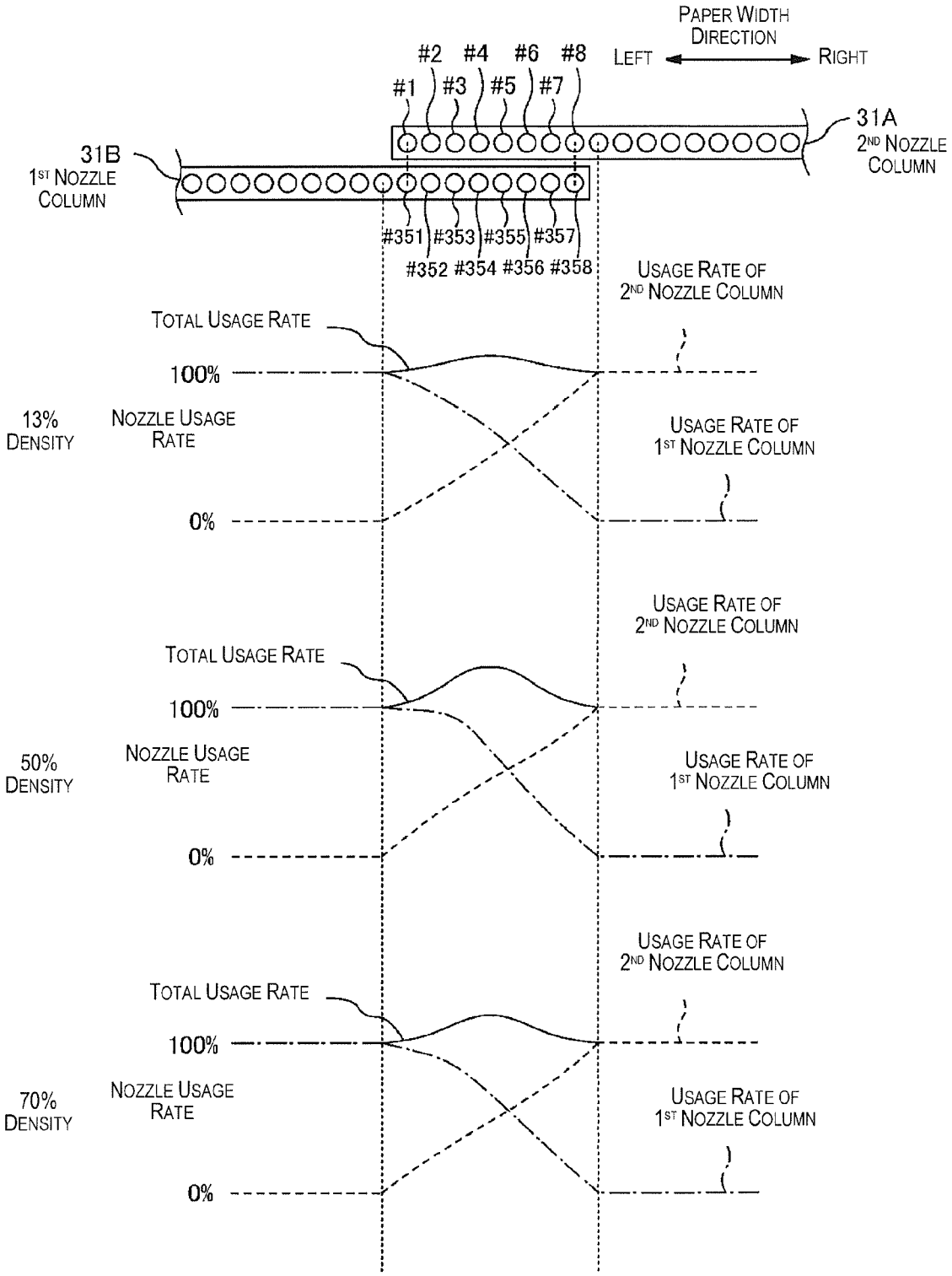
FIG. 25 is a drawing illustrating the nozzle usage rate in the second embodiment.

FIG. 25 is a drawing illustrating the nozzle usage rate in the second embodiment. The drawing shows the nozzle usage rates in the overlapping region. "Density" indicated in the drawing refers to the average density of the image to be printed on the medium. As an example, the nozzle usage rates when the average density is 13% (average input gradation value of 33), the nozzle usage rates when the average density is 50% (average input gradation value of 128), and the nozzle usage rates when the average density is 70% (average input gradation value of 179) are shown.

In the second embodiment, there is obtained an average value with regards to gradations obtained during the stage of step S208 in FIG. 8 described above, whereby a corresponding nozzle usage rate is obtained. Also, while nozzle usage rates in relation to three densities are shown in FIG. 25, with regards to a usage rate in relation to a density that is not shown here, a usage rate obtained by interpolation of the above usage rates is to be used.

Thus, it is possible to generate a dot on the basis of a nozzle usage rate created according to the probability of a white spot being generated. Then, it is possible to produce an appropriate amount of dots, and minimize any decrease in image quality in the overlapping region.

Third Embodiment

Figure 26:
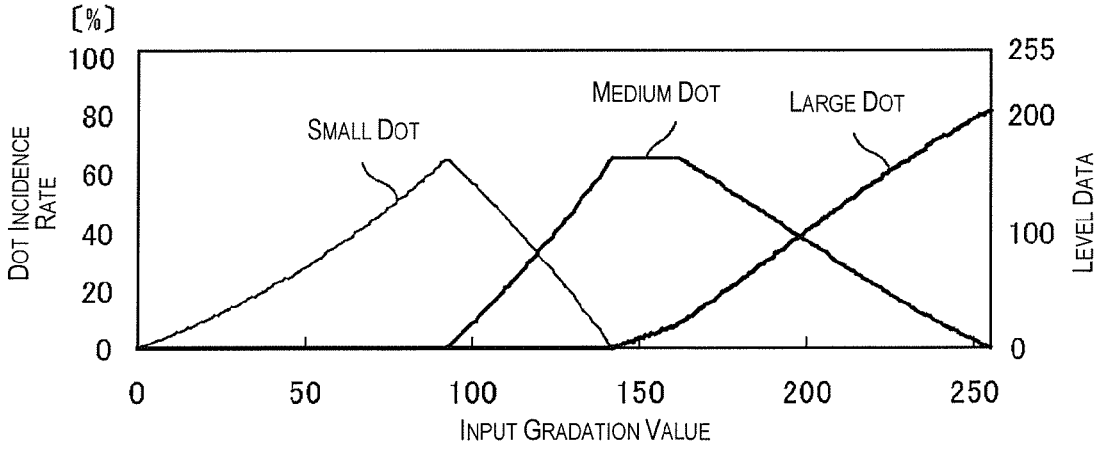
FIG. 26 is a drawing showing a dot incidence rate conversion table for the overlapping region according to a third embodiment

FIG. 26 shows a dot incidence rate conversion table for the overlapping region according to a third embodiment. In the third embodiment, the dot incidence rate conversion table to be used is different between the overlapping region and the non-overlapping region. In the third embodiment, the dot incidence rate conversion table shown in FIG. 7 described above is used for the non-overlapping region. The dot incidence rate conversion table shown in FIG. 26 is used for the overlapping region.

When the dot incidence rate conversion table shown in FIG. 7 is compared to the dot incidence rate conversion table shown in FIG. 26, the dot incidence rate conversion table for the overlapping region shown in FIG. 26 is the table according to which smaller dots being generated more readily. Also, the average dot size in the overlapping region is smaller than that in the non-overlapping region. The average dot size is one that satisfies the following equation.

Average dot size=small dot size×small dot size incidence ratio+medium dot size×medium dot size incidence ratio+large dot size×large dot size incidence ratio Here, small dot size incidence ratio+medium dot size incidence ratio+large dot size incidence ratio=1.

"Dot size" is taken to be proportional to ink amount.

Thus, it is possible to improve the graininess in the overlapping region while equalizing the average amount of ink ejected in the overlapping region and the average amount of ink ejected in the non-overlapping region.

Other Embodiments

The above-mentioned embodiments can be implemented in combination. For example, the first through third embodiments can be implemented in combination.

Each of the above-mentioned embodiments is described in relation to a printing system having principally an inkjet printer, and includes a disclosure of a density unevenness correction method and the like. The above-mentioned embodiments are described for the purpose of facilitating understanding of the invention, and shall not be construed as being of limitation to the invention.

It shall be apparent that the invention can be modified or improved without any departure being made from the main point thereof, and that the invention includes analogs thereof. In particular, embodiments described below are also included in the invention.

<Printer>

The embodiments described above describe an example of a printer in which a plurality of heads are arranged in a row along the extent of the paper width, wherein a paper sheet is conveyed under the fixed heads to form an image ("line head printer"). However, this is not provided by way of limitation. For example, the printer can be a "serial-type printer," in which a plurality of heads are arranged in a row in the direction of nozzle columns so that an end part of each of the nozzle columns of a plurality of heads overlaps another. Then, an action in which an image is formed while the heads are moved, relative to the paper sheet, along a direction that intersects the direction of the nozzle columns, and an action in which the paper sheet is conveyed, relative to the heads, along the direction of the nozzle columns, are alternately repeated.

In such an instance, as with the aforementioned embodiments, it is also possible to perform a halftone process on data obtained by multiplying the dot usage rate with dot incidence rate data (level data) for each dot size, and thereby obtain print data, with regards to an overlapping region in which the heads overlap.

<Fluid-Ejecting Device>

In the aforementioned embodiments, an inkjet printer is given as an example of a fluid-ejecting device; however, this is not provided by way of limitation. The invention can be applied not only to a printer but to a variety of industrial devices as long as the device is a fluid-ejecting device. For example, the invention can be applied to a fabric printing device for printing a pattern on a fabric; a color filter manufacturing device or a device for manufacturing an organic electroluminescence display or another display; a DNA chip manufacturing device for coating a chip with a solvent containing DNA dissolved therein and manufacturing a DNA chip; and other devices.

Also, the method used to spray the fluid can be a piezo method in which a voltage is applied to a driving element (piezo element), an ink chamber is caused to expand/contract, and a fluid is thereby ejected; or a thermal method in which a heat-generating element is used to generate air bubbles within a nozzle, and the air bubbles are used to eject a liquid. The fluid is not limited to a liquid such as an ink, and can also be a powder or another fluid.

What is claimed is:

1. A fluid-ejecting device comprising:

a first nozzle column in which first nozzles configured to eject a fluid are arranged in a predetermined direction; and a second nozzle column in which second nozzles configured to eject a fluid are arranged in the predetermined direction, the second nozzle column being arranged so as to form an overlapping region in which an end part on one side in the predetermined direction is superimposed over an end part of the first nozzle column on another side in the predetermined direction; and a control part configured to cause the fluid to be ejected so that in each of a plurality of raster lines arranged in a row in the predetermined direction in the overlapping region, dots to be formed are apportioned between the first nozzles and the second nozzles;

the control part being further configured to cause the fluid to be ejected so that in a raster line in the overlapping region, a pixel in which a dot formed by the first nozzles and a dot formed by the second nozzles are formed in a superimposed manner, and a pixel in which only one of a dot formed by the first nozzles and a dot formed by the second nozzles are formed are produced, the control part being further configured to cause, in the overlapping region, the fluid to be ejected from the first nozzle column and the second nozzles column according to dot data indicating dot sizes converted from an input image data, the dot data for the first nozzle column being obtained by multiplying incidence rate data for each of the dot sizes by a usage rate of the first nozzle column, the dot data for the second nozzle column being obtained by multiplying the incidence rate data for each of the dot sizes by a usage rate of the second nozzle column.

2. The fluid-ejecting device according to claim 1, wherein the dot data for the first nozzle column is obtained by further performing a halftone process after multiplying the incidence rate data for each of the dot sizes by the usage rate of the first nozzle column, and the dot data for the second nozzle column is obtained by further performing a halftone process after multiplying the incidence rate data for each of the dot sizes by the usage rate of the second nozzle column.

3. The fluid-ejecting device according to claim 1, wherein the usage rate of the first nozzles and the usage rate of the second nozzles differ in accordance with the input image data.

4. The fluid-ejecting device according to claim 1, wherein the incidence rate data for each of the dot sizes is determined in accordance with a table showing dot size, formed in accordance with a gradation value of the input image data, and the incidence rate at the corresponding dot size; and with regards to the table, a different table is used between the overlapping region and the non-overlapping region, which is not the overlapping region.

5. The fluid-ejecting device according to claim 1, wherein the control part causes the fluid to be ejected so that an average dot size in the overlapping region is smaller than an average dot size in the non-overlapping region.

6. The fluid-ejecting device according to claim 1, wherein the control part causes the fluid to be ejected so that the number of dots generated in the overlapping region is larger than the number of dots generated in a non-overlapping region, which is not the overlapping region.

7. The fluid-ejecting device according to claim 6, wherein an average amount of the fluid ejected in the overlapping region is equal to an average amount of the fluid ejected in the non-overlapping region.

8. A fluid-ejecting method comprising:

ejecting a fluid from a fluid-ejecting device including a first nozzle column in which first nozzles configured to eject a fluid are arranged in a predetermined direction, and a second nozzle column in which second nozzles configured to eject a fluid are arranged in the predetermined direction, the second nozzle column being arranged so as to form an overlapping region in which an end part on one side in the predetermined direction is superimposed over an end part of the first nozzle column on another side in the predetermined direction; and generating print data so that on a raster line in the overlapping region, a pixel in which a dot formed by the first nozzles and a dot formed by the second nozzles are formed in a superimposed manner, and a pixel in which only one of either a dot formed by the first nozzles or a dot formed by the second nozzles is formed are produced, the generating of the print data including multiplying incidence rate data for each of dot sizes, which are converted from an input image data, by a usage rate of the first nozzle column and multiplying the incidence rate data for each of the dot sizes by a usage rate of the second nozzle column to generate the print data, the ejecting including ejecting the fluid from the first nozzle column and the second nozzle column according to the print data.

* * * * *